US005829692A

United States Patent [19]

Walters

[11] Patent Number: 5,829,692

[45] Date of Patent: Nov. 3, 1998

[54] MODULARLY TIERED CLEAR-TRAJECTORY IMPACT COMMINUTER AND MODULAR COMMINUTION CHAMBER

[75] Inventor: Jerry Wayne Walters, Baton Rouge, La.

[73] Assignee: Wildcat Services Inc., Baton Rouge, La.

[21] Appl. No.: 784,365

[22] Filed: Jan. 17, 1997

Related U.S. Application Data

[63] Continuation-in-part of Ser. No. 627,766, Apr. 1, 1996, which is a continuation of Ser. No. 392,557, Feb. 21, 1995, Pat. No. 5,544,820.

[51] Int. Cl.[6] ..... B02C 13/282

[52] U.S. Cl. ..... 241/62; 241/73; 241/154; 241/188.1; 241/285.2

[58] Field of Search ..... 241/188.1, 189.2, 241/189.1, 285.2, 187, 242, 243, 101.77, 194, 73, 154, 62

[56] References Cited

U.S. PATENT DOCUMENTS

| | | | |
|---|---|---|---|
| 246,992 | 9/1881 | Anderson . | |
| 455,531 | 7/1891 | Good . | |
| 489,079 | 1/1893 | Kellner . | |

(List continued on next page.)

FOREIGN PATENT DOCUMENTS

| | | | |
|---|---|---|---|
| 178143 | 4/1986 | European Pat. Off. . | |
| 1238099 | 6/1960 | France | 241/187 |
| 1221082 | 7/1960 | Germany . | |
| 1209851 | 1/1966 | Germany . | |
| 1008093 | 5/1967 | Germany . | |
| 2126076 | 12/1971 | Germany . | |
| 2244951 | 3/1973 | Germany | 241/189.2 |
| 2015729 | 7/1994 | Russian Federation . | |
| 361464 | 5/1962 | Switzerland | 241/189.2 |
| 737007 | 5/1980 | U.S.S.R. | 241/242 |
| 1242233 | 7/1986 | U.S.S.R. | 241/194 |
| 1722570 | 3/1992 | U.S.S.R. | 241/195 |
| 1727898 | 4/1992 | U.S.S.R. . | |
| 685167 | 12/1952 | United Kingdom | 241/187 |

OTHER PUBLICATIONS

Pulva Corporation, "Impact Type Pulverizers", Product Literature.

Franklin Miller, Inc., "Delumper Crusher", Product Literature.

Atlantic Coast Crushers, Inc. "Crushers", Product Literature.

(List continued on next page.)

*Primary Examiner*—Mark Rosenbaum

*Attorney, Agent, or Firm*—Raymond G. Areaux; Lisa Charouel

[57] ABSTRACT

A modularly tiered clear-trajectory impact commuter apparatus that comminutes rock, drilling materials and other comminutable by impact rather than by grinding or crushing. The invention creates a comminution environment which maximizes the establishment of a clear essentially tangential trajectory for the material between the orbit of each spinning blade and a single rectangular breaker bar. The modular vertical series coupling of the modularly tiered clear-trajectory impact comminuter apparatus may be adjusted to accommodate the material throughput for any environment whereby, for any given size of comminution chamber and rotary blade configuration, any number of tierable, modular comminution chambers may be vertically tiered for achieving the desired material throughput in relation to the load of comminutable material. Such load of comminutable material is in terms of: 1) the volume requirements, per unit of time; 2) the size of the material to be comminuted; and 3) the desired final stage exiting particle size. Additionally, the modular construction of the tierable comminution chamber simplifies the manufacturing thereof, the assemblage thereof, and extends the useful life of the apparatus as a whole.

41 Claims, 20 Drawing Sheets

U.S. PATENT DOCUMENTS

| | | | |
|---|---|---|---|
| 1,472,609 | 10/1923 | Martin . | |
| 1,703,211 | 2/1929 | Schmierer . | |
| 2,188,230 | 1/1940 | Nicholson . | |
| 2,540,021 | 1/1951 | Wright . | |
| 2,555,879 | 6/1951 | Fogle . | |
| 2,607,538 | 8/1952 | Larson | 241/194 X |
| 2,644,644 | 7/1953 | West . | |
| 2,768,938 | 10/1956 | Martin . | |
| 2,903,192 | 9/1959 | Clausen . | |
| 3,226,045 | 12/1965 | Shelton et al. . | |
| 3,260,468 | 7/1966 | Beard . | |
| 3,428,859 | 2/1969 | Zifferer . | |
| 3,471,093 | 10/1969 | Wienert . | |
| 3,480,214 | 11/1969 | Wageneder et al. . | |
| 3,608,841 | 9/1971 | Wageneder et al. . | |
| 3,610,544 | 10/1971 | O'Connor . | |
| 3,895,760 | 7/1975 | Snyder . | |
| 3,995,814 | 12/1976 | Alberts . | |
| 4,077,574 | 3/1978 | Francis . | |
| 4,088,528 | 5/1978 | Berger . | |
| 4,090,673 | 5/1978 | Ackers et al. . | |
| 4,093,127 | 6/1978 | Alberts et al. . | |
| 4,151,959 | 5/1979 | Deister . | |
| 4,274,601 | 6/1981 | Musto . | |
| 4,333,278 | 6/1982 | Schulte et al. . | |
| 4,371,117 | 2/1983 | von Bennigsen . | |
| 4,373,678 | 2/1983 | Reitter . | |
| 4,373,679 | 2/1983 | Kawano et al. . | |
| 4,619,409 | 10/1986 | Harper . | |
| 4,729,516 | 3/1988 | Williams | 241/194 X |
| 4,733,826 | 3/1988 | Komori et al. . | |
| 4,934,614 | 6/1990 | Lewis . | |
| 5,031,845 | 7/1991 | Gemsjager . | |
| 5,074,477 | 12/1991 | Welter et al. . | |
| 5,161,746 | 11/1992 | Bliss | 241/189.2 |
| 5,184,784 | 2/1993 | Rose et al. . | |
| 5,248,101 | 9/1993 | Rose et al. . | |
| 5,272,861 | 12/1993 | Roynberg | 241/194 X |
| 5,280,857 | 1/1994 | Reichner . | |
| 5,395,417 | 3/1995 | Thomas . | |
| 5,400,977 | 3/1995 | Hayles, Jr. . | |
| 5,511,729 | 4/1996 | Husain . | |
| 5,544,820 | 8/1996 | Walters | 241/194 X |
| 5,562,257 | 10/1996 | Graveman . | |
| 5,577,669 | 11/1996 | Vujnovic | 241/285.2 |

OTHER PUBLICATIONS

Scott Equipment Company, "Dominator Crusher", Product Literature.

Scott Equipment Company, "Scott ASM Fine Grinder", Product Literature.

Hosokawa Bepex Corporation, "We offer total . . . ", Product Literature.

Franklin Miller, "Solids Reduction Processors", Product Literature.

Buffalo Hammer Mill Corporation, "R Series Dual–Stage Hammer Mill", Product Literature.

Franklin Miller, "Taskmaster", Product Literature.

Modern Process Equipment Inc., "The MPE Gran–u–lizer™", Product Literature.

MODULARLY TIERED CLEAR-TRAJECTORY IMPACT COMMINUTER AND MODULAR COMMINUTION CHAMBER

The following application is a continuation-in-part of co-pending application Ser. No. 08/627,766, filed Apr. 1, 1996 which is a continuation of application Ser. No. 08/392,557, filed Feb. 21, 1995 now U.S. Pat. No. 5,544,820.

TECHNICAL FIELD

The present invention relates to an apparatus for comminuting rock, drilling material or other comminutable material of various sizes and, more particularly, to a modularly tiered clear-trajectory impact comminuter apparatus that comminutes rock, drilling materials, fibrous material and other comminutable material by impact rather than by grinding or crushing. The invention creates a comminution environment which maximizes the establishment of a clear essentially tangential trajectory for the material between the orbit of each spinning blade and a single rectangular breaker bar having a fissure formed therein. The modular vertical series coupling of the modularly tiered clear-trajectory impact comminuter apparatus may be adjusted to accommodate the material throughput for any environment whereby, for any given size of comminution chamber rotary blade configuration, any number of tierable, modular comminution chambers may be vertically tiered for achieving the desired material throughput in relation to the load of comminutable material. Such load of comminutable material is in terms of: 1) the volume requirements, per unit of time; 2) the size of the material to be comminuted; and 3) the desired final stage exiting particle size. The modular construction of each comminution chamber simplifies the manufacturing thereof, the assemblage thereof and extends the useful life of the apparatus of the present invention, as a whole.

BACKGROUND OF THE INVENTION

In many rotary driven comminution apparatuses, comminution of comminutable material takes place in a plurality of parallel sub-chambers formed in a single master comminution chamber. One such system that divides a single master comminution chamber into parallel sub-chambers is described by me in U.S. Pat. No. 5,544,820. Because the rotary driven comminution apparatuses are single master comminution chambers having a unitarily constructed housing, malfunction of the interior comminution components of the master comminution chamber are not easily replaceable and the comminution process is halted. Moreover, the comminution chamber's interior surfaces and interior comminution components are often severely degraded from the repeated comminution of comminutable material thereby requiring replacement thereof to maintain the efficiency of the comminution process. Halting the comminution process at an installation site may create the need to store or inventory comminutable material which is undesirable for installation sites with space limitations. Moreover, depending on the operations of the installation site, operations of the site may need to be stopped until the comminution apparatus is back online. As a result, the installation site experiences a loss in production time and an increase in operating costs.

Furthermore, the operations of an installation site may produce a very large load of comminutable material which requires comminution. The single master comminution chambers of known apparatuses may not provide enough throughput for such a very large load of comminutable material.

Several comminution-type apparatuses have been patented with an opening in the roof portion of the comminution chamber.

U.S. Pat. No. 5,511,729, by Husain, is directed to a comminution chamber having an opening in the roof portion of the comminution chamber. However, the comminution chamber of the invention, by Husain, does not create a comminution environment which maximizes the establishment of a clear essentially tangential trajectory for the material between the orbit of each spinning blade and a single rectangular breaker bar having a fissure formed therein coupled to a near-flat roof. Furthermore, the comminution chamber of the invention, by Husain, is not modular in construction.

Union Soviet Socialist Republics Patent No. 1 727 898 is also directed to a comminution chamber having an opening in the roof portion. Nevertheless, the comminution chamber does not create a comminution environment which maximizes the establishment of a clear essentially tangential trajectory for the material between the orbit of each spinning blade and a single rectangular breaker bar having a fissure formed therein coupled to a near-flat roof. Moreover, the comminution chamber is not modular in construction.

U.S. Pat. No. 4,077,574, by Francis, is directed to an impact attrition mill having an attrition chamber stacked above a primary reduction chamber and a classification chamber. The invention, by Francis, is not directed to a modularly tiered clear-trajectory impact comminuter apparatus having a plurality of modular comminution chambers coupled in series, as is the present invention.

Literature directed to vertically stacked chambers include "R Series Dual-Stage Hammer Mill," by Buffalo Hammer Mill Corporation, and "Taskmaster," by Franklin Miller.

Product literature, "R Series Dual-Stage Hammer Mill," by Buffalo Hammer Mill Corporation (the "R Series Literature"), is directed to a dual-stage hammer mill apparatus wherein the comminution chambers are vertically stacked. The R Series Literature shows: (1) a drawing of a single shaft hammer comminution chamber wherein each shaft requires its own motor device coupled thereto; (2) that the first stage of the dual-stage hammer mill apparatus does not filter comminuted material of the first stage into the next stage of the hammer mill apparatus, as does the present invention; (3) that the apparatus does not provide a fissure formed in a single rectangular breaker bar wherein comminutable material is fractured on impact in a clear-trajectory modular comminution chamber, as does the present invention; (4) that the apparatus does not use concatenation of rotary power to the vertically coupled modular comminution chambers; and (5) that the two shafts do not counter rotate.

Product literature, "Taskmaster," by Franklin Miller (the "Taskmaster Literature"), is directed to a single stage comminution apparatus and a dual-stage comminution apparatus for shredding packaging and other paper products, hospital waste, aluminum cans and PET/HDPE bottles. The Taskmaster Literature does not teach comminution of rock and drilling material, nor do the apparatuses shown in the Taskmaster Literature appear to be suitable for comminution of such rock and drilling material. Moreover, the apparatuses shown in the Taskmaster Literature are not directed to a comminution chamber having a fissure formed in a single rectangular breaker bar wherein the comminutable material is fractured on impact in the comminution chambers, as is the present invention.

SUMMARY OF THE INVENTION

The preferred embodiment of the modularly tiered clear-trajectory impact comminuter apparatus of the present invention solves the aforementioned problems in a straight forward and simple manner. What is provided is a modularly tiered clear-trajectory impact comminuter apparatus that comminutes rock, drilling materials, fibrous material and other comminutable material by impact rather than by grinding or crushing. The invention creates a comminution environment which maximizes the establishment of a clear essentially tangential trajectory for the material between the orbit of each spinning blade and a single rectangular breaker bar having a fissure formed therein. The vertical series coupling of the modularly tiered clear-trajectory impact comminuter apparatus may be adjusted to accommodate the material throughput for any environment whereby, for any given size of comminution chamber and rotary blade configuration, any number of tierable, modular comminution chambers may be vertically tiered for achieving the desired material throughput in relation to the load of comminutable material. Such load of comminutable material is in terms of: 1) the volume requirements, per unit of time; 2) the size of the material to be comminuted; and 3) the desired final stage exiting particle size. The modular construction of each tierable comminution chamber simplifies the manufacturing thereof, the assemblage thereof and extends the useful life of the apparatus of the present invention, as a whole.

In particular, the comminution chamber for comminuting material comprises a housing wall structure forming a chamber for operatively housing therein a rotary blade and having a material inlet port formed therein; and, a breaker bar having a fissure aligned with said material inlet port for feeding therethrough said material to said chamber wherein a clear-trajectory zone is established in relation to said rotary blade and said breaker bar.

In particular, the modularly tiered clear-trajectory impact comminuter apparatus for comminuting comminutable material of the present invention comprises a plurality of tierable, modular comminution chambers wherein the plurality of tierable, modular comminution chambers includes at least a first stage comminution chamber and a final stage comminution chamber and each of the tierable, modular comminution chambers is modularly, vertically coupled in series. Each tierable, modular comminution chamber comprises a fissure formed in a single rectangular breaker bar wherein each fissure, except the fissure of the first stage comminution chamber, couples to the output of each preceding stage comminution chamber via a transfer conduit.

In view of the above, an object of the invention is to provide a tierable, modular comminution chamber comprising a near-flat roof having a material inlet port and having coupled thereto a single rectangular breaker bar having a fissure which aligns with said material inlet port (which generally extends the length of the tierable, modular comminution chamber) whereby the flow of comminutable material into the tierable, modular comminution chamber is increased for optimizing the efficiency of the comminution process.

A further object of the invention is to provide a material intake duct system which allows comminutable material to free fall or be mechanically fed through the fissure via said material inlet port of the first stage comminution chamber.

Another object of the invention is to provide a transfer conduit for transferring comminuted material from the output of a preceding stage comminution chamber to the material inlet port of the succeeding stage comminution chamber.

Still another object of the invention is to provide concatenation of rotary power to any number of tierable, modular comminution chambers via two counter-rotating motor means wherein each of the tierable, modular comminution chambers is a dual-shaft tierable, modular comminution chamber.

Yet a still further object of the invention is to provide an injection distribution system which is modularly structured to provide water, air, steam, a chemical mixture or the like to any number of the tierable, modular comminution chambers.

Yet a still further object of the invention is to provide screen members which generally extend the length of the tierable, modular comminution chamber whereby the screen members of each succeeding stage comminution chamber filters comminuted material dimensioned smaller than the preceding stage comminution chamber.

Yet a still further object of the invention is to provide a material transport system which is designed to swiftly transfer comminuted material from the final stage comminution chamber for distribution thereof.

Yet a still further object of the invention is to provide a tierable, modular comminution chamber comprising a modular housing wall structure. The modular housing wall structure comprises a plurality of symmetrical pairs of wall structure segments, a bottom center material guide member and end side wall structures for forming a slightly overlapping double cylindrical barrel and the hollow interior thereof forms a comminution chamber.

In view of the above objects, a feature of the present invention is that the tierable, modular comminution chamber housing and like components of the interior comminution components are substantially identical thereby minimizing the manufacturing cost of the tiered impact clear-trajectory comminuter apparatus.

A further feature of the present invention is that the plurality of symmetrical wall structure segments, bottom center material guide member and end side wall structures allow the modular comminution chamber to be easily assembled. Moreover, the symmetrical wall structure segments are easily replaceable or repaired thereby extending the useful life of the tierable, modular comminution chamber and allow for the quick and easy maintenance thereof.

An advantage of the present invention is that the modular tiering of the tiered clear-trajectory impact comminuter apparatus minimizes the amount of space required at an installation site.

Another advantage of the present invention is that if deterioration or a malfunction occurs in one of the plurality of tierable, modular comminution chambers, the components of the modular housing wall structure and interior comminution components of said one can replace the like components in the other tierable, modular comminution chambers when repairs are required.

A further advantage of the present invention is that the attributes of modular tiering allows my apparatus to accommodate increases or decreases in the material throughput as load levels increase or decrease by increasing or decreasing, at any time, the number of tierable, modular comminution chambers thereby avoiding any build-up of comminutable material. Furthermore, the modular tiering accommodates batch loads or continuous loads of comminutable material of any volume.

The above objects, features and advantages of the present invention will become apparent from the drawings, the description given herein, and the appended claims.

BRIEF DESCRIPTION OF THE DRAWINGS

For a further understanding of the nature and objects of the present invention, reference will be made to the following detailed description, taken in conjunction with the accompanying drawings, in which like elements are given the same or analogous reference numbers and wherein.

DESCRIPTION OF THE EXEMPLARY EMBODIMENT

Figure 1:
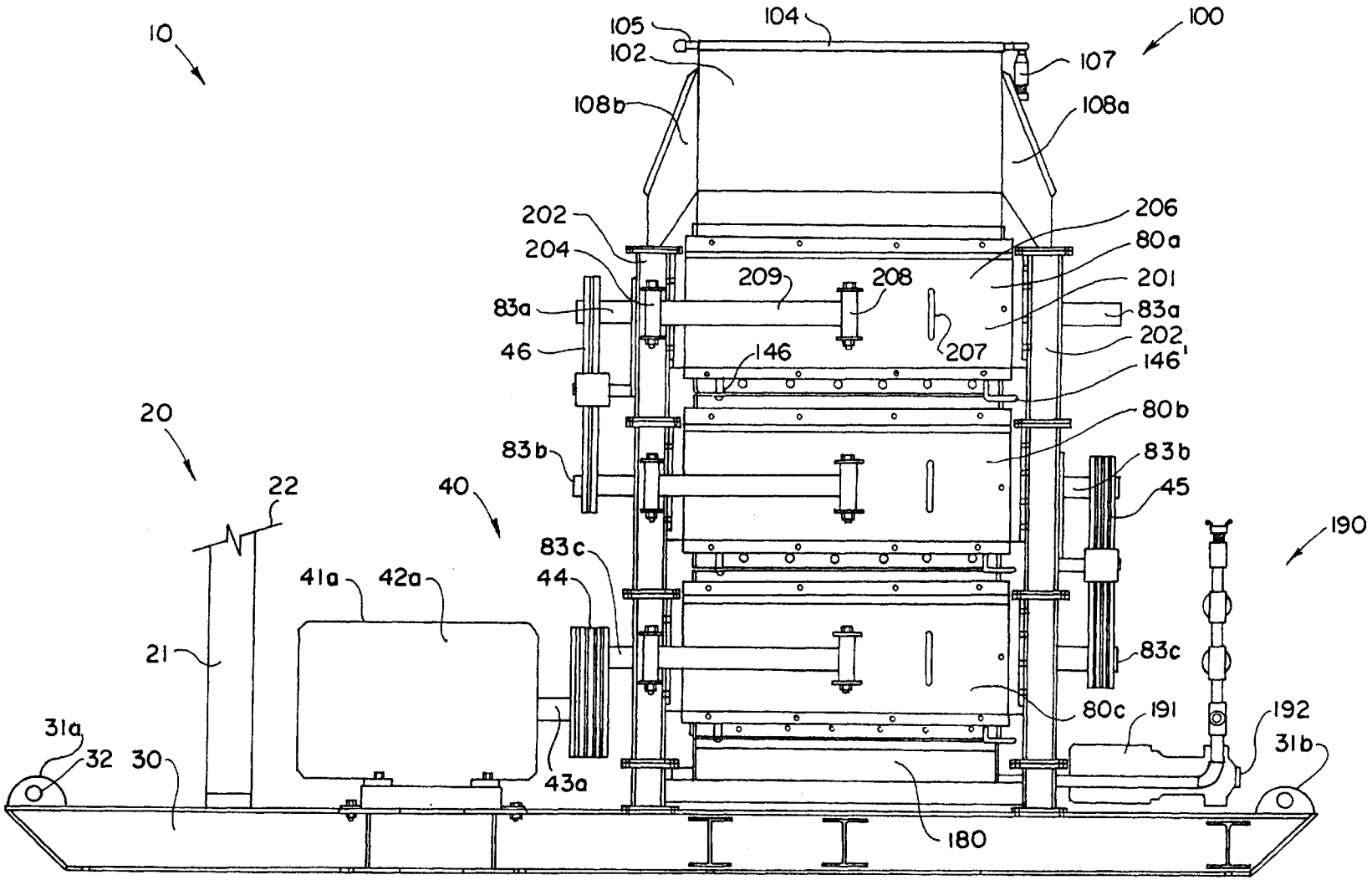
FIG. 1 illustrates a front view of the modularly tiered clear-trajectory impact comminution apparatus of the present invention.
Figure 2:
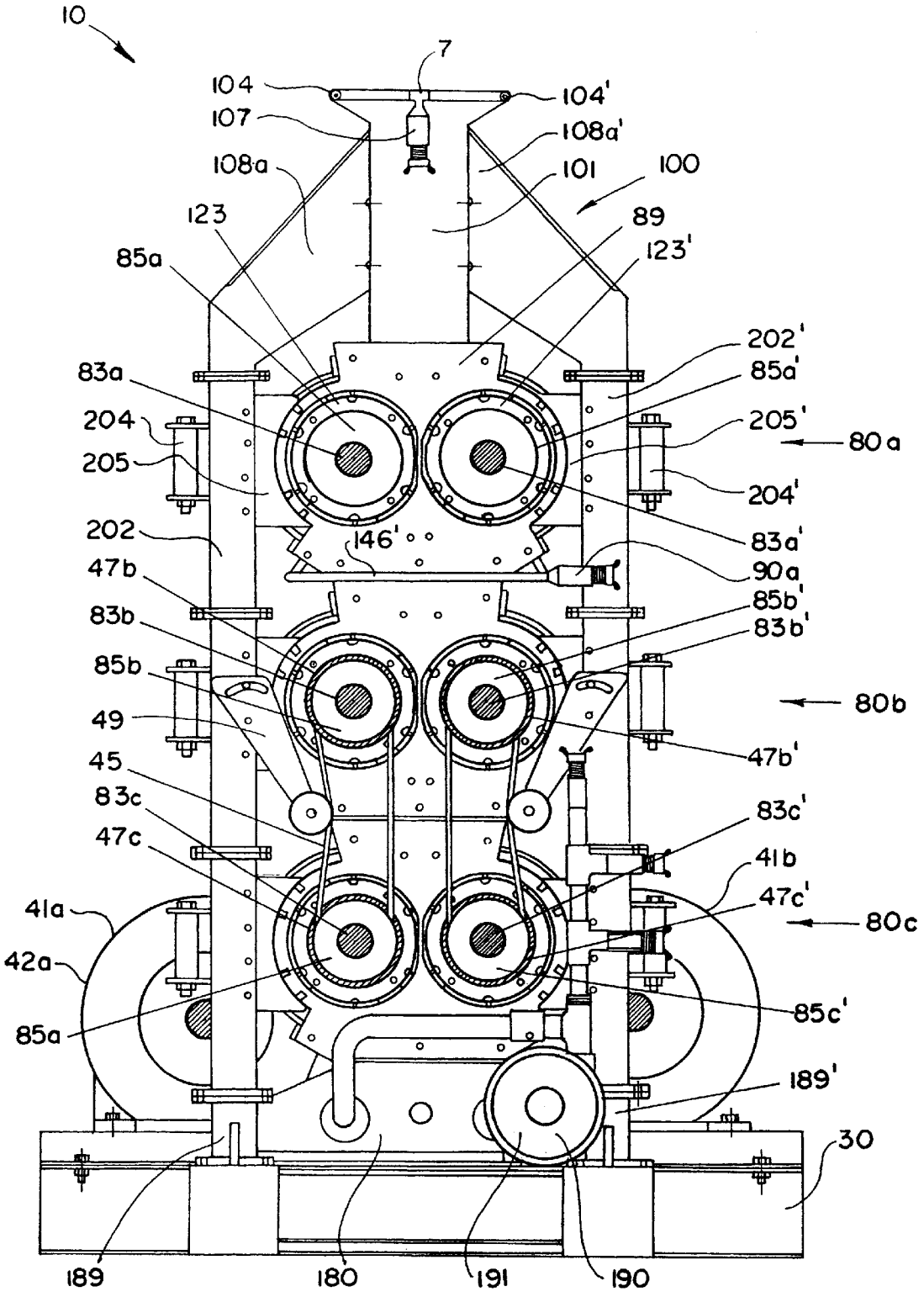
FIG. 2 illustrates an end view of the modularly tiered clear-trajectory impact comminution apparatus of FIG. 1.

Referring now to the drawings, and in particular FIGS. 1 and 2, front and end views of the modularly tiered clear-trajectory impact comminuter apparatus of the present invention are illustrated wherein the modularly tiered clear-trajectory impact comminuter apparatus is designated generally by the numeral 10. Modularly tiered clear-trajectory impact comminuter apparatus 10 of FIGS. 1 and 2 is comprised of control system 20, transport skid structure 30, power rotation system 40, injection distribution system 190, material intake duct 100, material transport system 180 and a plurality of tierable, modular comminution chambers 80*a*, 80*b* and 80*c*.

Comminution of a load of comminutable material of an installation site takes place in the plurality of tierable, modular comminution chambers 80*a*, 80*b*, and 80*c*, each of which is vertically coupled in series. I have determined that by vertically coupling in series a plurality of tierable, modular comminution chambers 80*a*, 80*b*, and 80*c* greater throughput of comminutable material may be obtained for installation sites which have a very large load of comminutable material. Nevertheless, the modular tiering, of any number of tierable, modular comminution chambers, allows modularly tiered clear-trajectory impact comminuter 10 to accommodate different load levels of comminutable material of various sizes for any installation site. Said modular tiering may be adjusted to accommodate the material throughput for any environment whereby, for any given size of comminution chamber and rotary blade configuration, any number of tierable, modular comminution chambers may be vertically tiered for achieving the desired material throughput in relation to the load of comminutable material. Such load of comminutable material is in terms of: 1) the volume requirements, per unit of time; 2) the size of the material to be comminuted; and 3) the desired final stage exiting particle size. Additionally, the attributes of modular tiering allows my apparatus to accommodate increases or decreases in the material throughput as load levels increase or decrease by increasing or decreasing, at any time, the number of tierable, modular comminution chambers thereby avoiding any build-up of comminutable material. For example, adding tierable, modular comminution chambers results in added levels of classification therefore producing finer product (meaning smaller particles) more rapidly. Furthermore, the modular tiering accommodates batch loads or continuous loads of comminutable material of any volume. Furthermore, vertically coupling in series the plurality of tierable, modular comminution chambers 80*a*, 80*b*, and 80*c* minimizes the amount of space required at the installation site for installing my modularly tiered clear-trajectory impact comminuter apparatus 10. Henceforth, my modularly tiered clear-trajectory impact comminuter apparatus 10 is advantageous for installation sites which have limited available space, such as an offshore platform, for operations.

Alternatively, my clear-trajectory impact comminuter apparatus 10 may couple each tierable, modular comminution chamber 80*a*, 80*b* and 80*c* in series via a transfer mechanism such that said comminution chambers are not stacked vertically.

Figure 6:
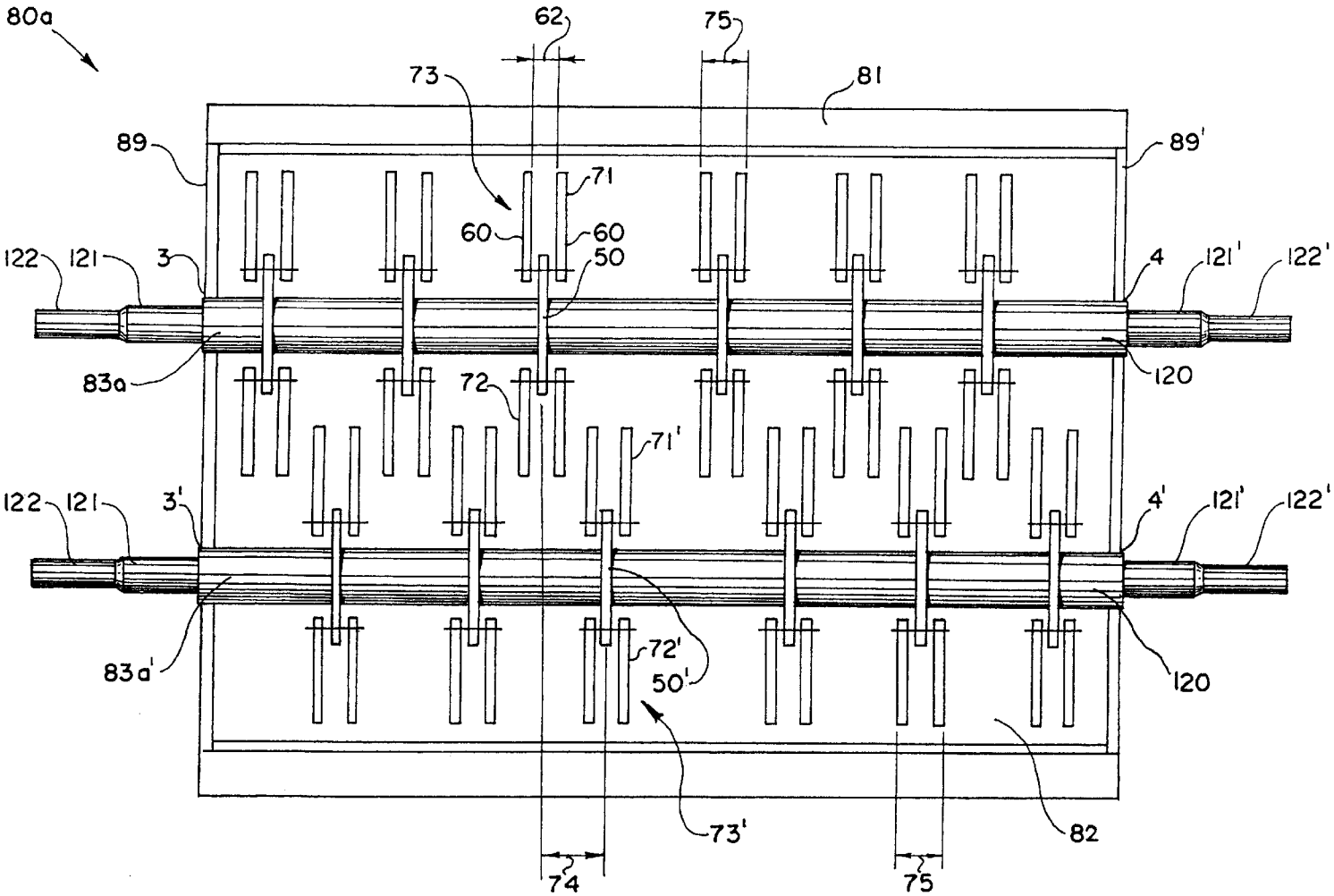
FIG. 6 illustrates an inside bottom view of the tierable, modular comminution chamber of the present invention.

Furthermore, I have determined that by constructing my tierable, modular comminution chamber with a modular housing wall structure 81 comprising a plurality of symmetrical pairs of wall structure segments, a bottom center material guide member and end side wall structures the useful life of the present invention will be extended and ease and speed of maintenance enhanced. Therefore, each wall structure segment of the plurality of symmetrical pairs of wall structure segments, end side wall structures 89 and 89' and bottom center material guide member 150 may be replaced and/or repaired, as needed. Moreover, an advantage of the present invention is that if deterioration or a malfunction occurs in one of the plurality of tierable, modular comminution chambers, the components of the modular housing wall structure and interior comminution components of said one can replace the like components in the other tierable, modular comminution chambers when repairs are required. The interior surfaces of the plurality of symmetrical pairs of wall structure segments, the bottom center material guide member 150 and end side wall structures 89 and 89' may be provided with replaceable liners thereby further simplifying the repairs to my tierable, modular comminution chamber. Since each of the plurality of tierable, modular comminution chambers are identical the manufacturing cost of my tiered impact clear-trajectory comminuter apparatus 10 is minimized. Moreover, in the preferred embodiment, the like components of the interior comminution components are identical. Such interior comminution components comprise first and second split rectangular breaker bar members 84' and 84" (FIG. 3), rotary shafts 83*a*, 83*a'*, 83*b*, 83*b'*, 83*c* and 83*c'*, the plurality of sleeves 50 and 50' (FIG. 6) and the blades of the pair of parallel blades 60 (FIG. 6). Since tierable, modular comminution chambers 80*a*, 80*b*, 80*c* are identical, in the preferred embodiment, only one such tierable, modular comminution chamber will be described in detail. Nevertheless, each of said tierable, modular comminution chambers and the like components of the interior comminution components may be of varying sizes.

Figure 3:
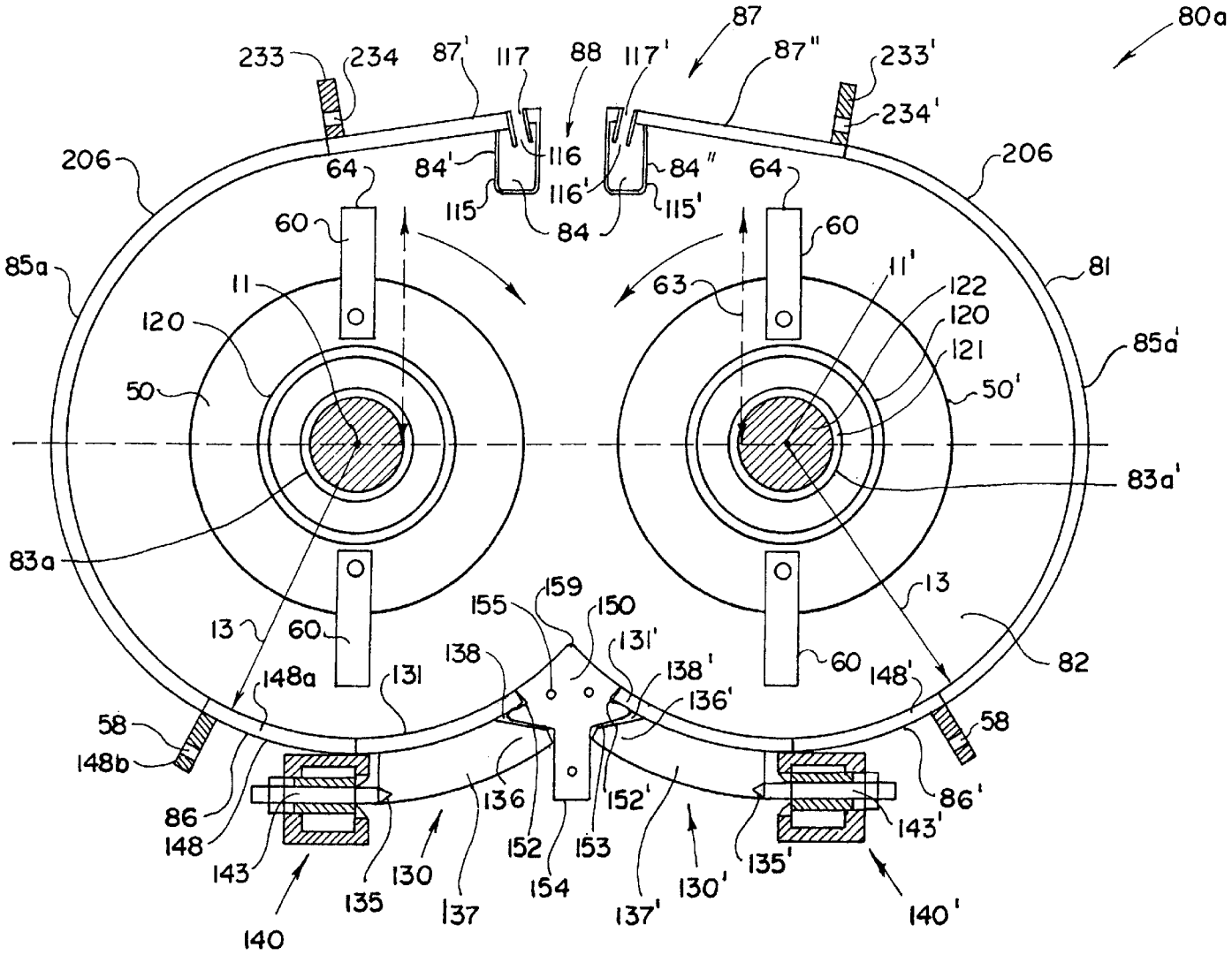
FIG. 3 illustrates a cross-sectional view of the tierable, modular comminution chamber of the present invention.

Referring to FIG. 3, a cross-sectional view of the tierable, modular comminution chamber of the present invention is shown. Modular housing wall structure 81 of tierable, modular comminution chamber 80*a* comprising the plurality of symmetrical pairs of wall structure segments, bottom center material guide member 150 and end side wall structures 89 and 89' (FIG. 6) is shaped to form a slightly overlapping double cylindrical barrel wherein the hollow interior thereof forms comminution chamber 82. The term "slightly overlapping" refers to the overlapping feature of the barrels 85*a* and 85*a'*. Rather than barrels 85*a* and 85*a'* being juxtaposed in a parallel manner (like a shotgun barrel or a pair of binoculars), barrels 85*a* and 85*a'*, while parallel, are configured to sightly overlap and thus create a contiguous comminution chamber 82 which results from the removal of the overlapping barrel material and from the substitution of the center section of the dual-arched roof with an elliptical, low arch, or near-flat roof, as described in U.S. Pat. No. 5,544,820, incorporated herein by reference as if set forth in full below. The barrels 85*a* and 85*a'* have barrel bellies 86 and 86', respectively, defined by the lower portion of modular housing wall structure 81.

Figure 4:
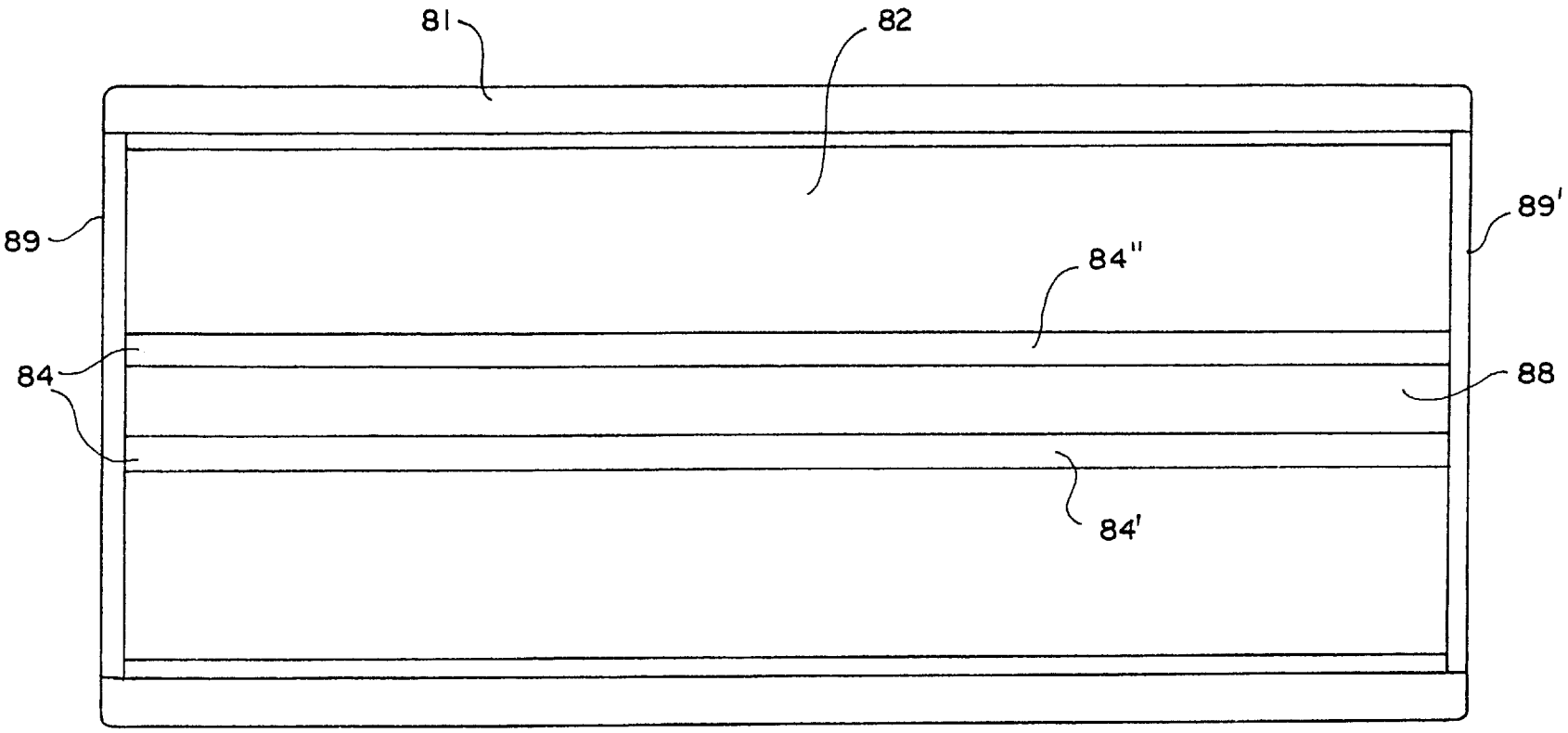
FIG. 4 illustrates an inside top view of the tierable, modular comminution chamber of the present invention.

In order to increase the flow of comminutable material into each tierable, modular comminution chamber, for optimizing the efficiency of the comminution process of each tierable, modular comminution chamber, I split my single rectangular breaker bar, described in U.S. Pat. No. 5,544,820, to form fissure 88 was which generally extends the length of comminution chamber 82, as shown in FIG. 4, and I aligned the near-flat roof aperture, which is used as the material inlet port, along said fissure. Henceforth, the split in my near-flat roof provides a material inlet port to fissure 88 wherein fissure 88 provides a material inlet means for feeding therethrough the flow of comminutable material into each tierable, modular comminution chamber of the plurality of tierable, modular comminution chambers 80*a*, 80*b*, and 80*c* vertically coupled in series. As comminutable material is fed into fissure 88 via said material inlet port of each of the vertically coupled in series, modular comminution chambers 80*a*, 80*b* and 80*c*, comminutable material is distributed more evenly along the length of comminution chamber 82 thereby effectively utilizing the full capacity of comminution chamber 82 and reducing blade wear and degradation. Henceforth, the efficiency of the comminution process of each tierable, modular comminution chamber of the plurality of tierable, modular comminution chambers 80*a*, 80*b*, and 80*c* is increased with splitting my single rectangular breaker bar for forming fissure 88 therein and aligning the near-flat roof aperture, which serves as the material inlet port, along said fissure. Moreover, my clear-trajectory zone is maintained and enhanced in comminution chamber 82 such that there is no downward movement of new comminutable material entering comminution chamber 82 opposing the clear-trajectory path of the existing comminuted material in comminution chamber 82 and no other breaker bars or stationary impediments exist within barrels 85*a* and 85*a'* of tierable, modular comminution chamber 80*a*.

The upper portion of the modular housing wall structure 81 comprises near-flat roof 87 having centrally coupled thereto single rectangular breaker bar 84 extending along the length of comminution chamber 80*a* wherein said single rectangular breaker bar 84 has fissure 88 formed therein. Near-flat roof 87 is comprised of first and second near-flat roof members 87' and 87" wherein first and second near-flat roof members 87' and 87" are the first symmetrical pair of wall segments of the plurality of symmetrical pairs of wall segments. First near-flat roof member 87' is spaced a distance from second near-flat roof member 87" wherein the space or aperture defined by said distance functions as a material inlet port. Each of first and second near-flat roof members 87' and 87" comprises a plurality of apertures 117 and 117', respectively, spaced therealong. The term "near-flat roof" refers to the substitution of the center section of the dual-arched roof, which dual-arched roof would otherwise be formed by the overlapping barrels 85*a* and 85*a'*, with an elliptical, low arch or near-flat roof. In lieu of the dual-arch at the top and center of tierable, modular comminution chamber 80*a*, the roof is near-flat or somewhat elliptical in order to allow the needed clearance for the comminutable material's trajectory toward single rectangular breaker bar 84.

The bottom surfaces of the free ends of first and second near-flat roof members 87' and 87" each has coupled thereto first and second split rectangular breaker bar members 84' and 84", respectively, of single rectangular breaker bar 84 having fissure 88 formed therein wherein fissure 88 is aligned with said material inlet port. First split rectangular breaker bar member 84' and second split rectangular breaker bar member 84" each comprise a plurality of spaced apertures 116 and 116', respectively, aligned with the plurality of apertures 117 and 117', respectively, for modularly securing to near-flat roof members 87' and 87", respectively, via a plurality of securing means, such as a bolt, (not shown). First and second split rectangular breaker bar members 84' and 84" extend from end side wall structure 89 to end side wall structure 89', as shown in FIG. 4. First and second split rectangular breaker bar members 84' and 84" are provided in the orbital tangential trajectory paths formed by the counter-exerted centrifugal forces in barrels 85*a* and 85*a'*, respectively. Thus, comminutable material can be flung by the rotary lifters 73 and 73' (FIG. 6) toward first and second split rectangular breaker bar members 84' and 84" in said clear-trajectory zone of barrels 85*a* and 85*a'*.

Referring to FIG. 6, an inside bottom view of the tierable, modular comminution chamber of the present invention is illustrated. Tierable, modular comminution chamber 80*a* comprises two parallel and coplanar bearing mounted rotary shafts 83*a* and 83*a'* wherein the axes of rotary shafts 83*a* and 83*a'* are the same as the axes of barrels 85*a* and 85*a'* (FIG. 3), respectively. Said axes are defined by points 11 and 11' (FIG. 3), respectively. End side wall structures 89 and 89' perpendicularly couple to first and second distal ends, respectively, of modular housing wall structure 81 thereby enclosing comminution chamber 82. Rotary shafts 83*a* and 83*a'* are journaled through holes 3 and 3', respectively, in end wall structure 89, and 4 and 4', respectively, in end wall structure 89'. Since rotary shafts 83*a* and 83*a'* are identical except for their direction of rotation, only one such rotary shaft will be described in detail.

Figure 5:
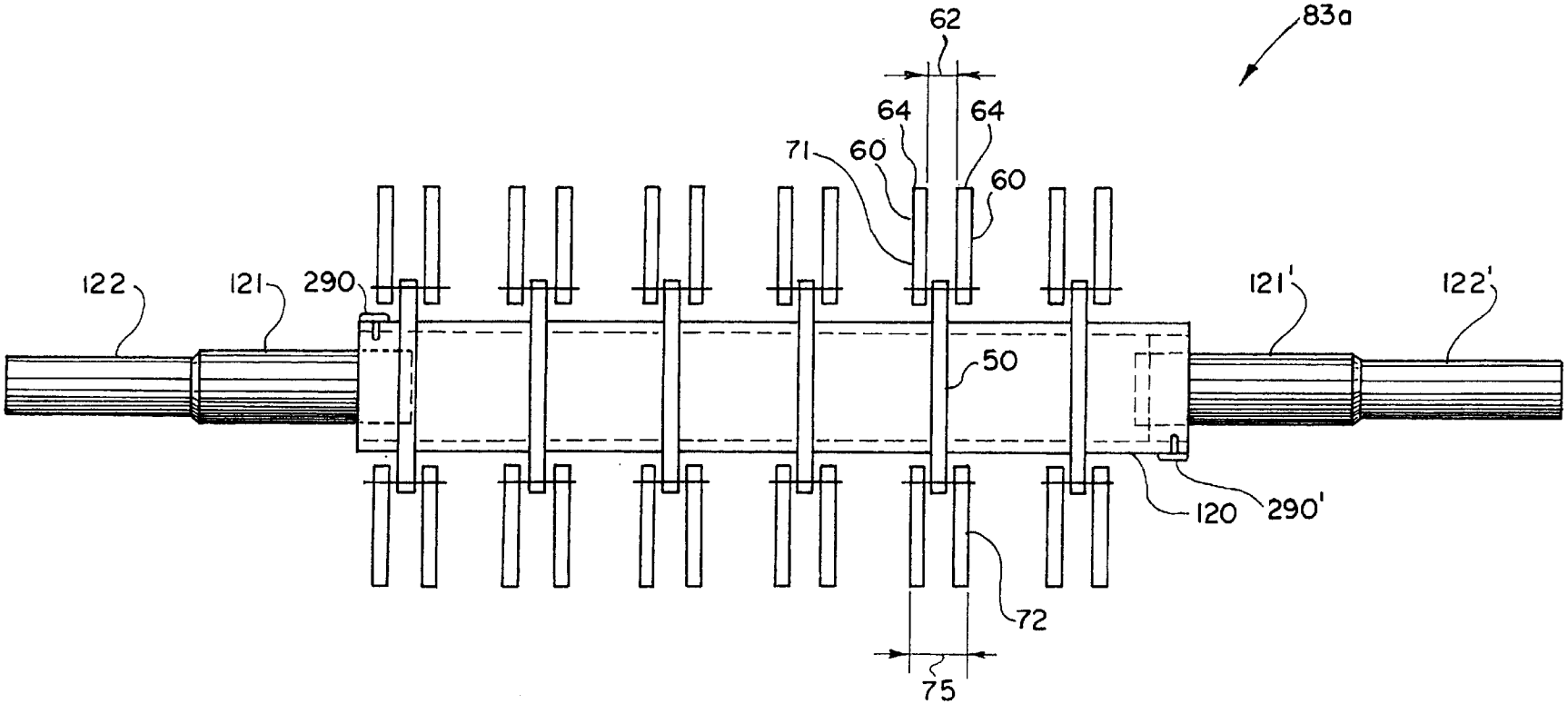
FIG. 5 illustrates a detailed view of the rotary shaft and the plurality of rotary lifters of the present invention.

Referring to FIG. 5, a detailed view of the rotary shaft and the plurality rotary lifters of the present invention is shown. Rotary shaft 83*a* comprises first shaft member 120, second shaft members 121 and 121' and third shaft members 122 and 122'. First shaft member 120 is a hollow cylindrically shaped member substantially extending the length of tierable, modular comminution chamber 80*a*, as shown in FIG. 6. The hollow properties of first shaft member 120 provides a stronger shaft which is easily balanced; and whereby the wall thickness of first shaft member 120 can be adjusted to the desired torque requirements. The diameter of first shaft member 120 is optimized to 1) provide sufficient free space for the orbit of the comminutable material; 2) optimize the clear trajectory zone for maintaining the comminutable material in the desired orbit of said clear-trajectory zone; and 3) minimize damage, wear and degradation, such as dents, to the surface of first shaft member 120 during the comminution process. In order to further minimize damage, wear and degradation, first shaft 120 may be coated with a highly durable coating.

Each distal end of first shaft member 120 has fixedly coupled thereto one distal end of second shaft members 121 and 121' which have a diameter less than the diameter of first shaft member 120. Second shaft members 121 and 121' have a length sufficient to support bearing housings 123 and 123' (FIG. 2), respectively. The other distal ends of second shaft members 121 and 121' have fixedly coupled thereto one end of third shaft members 122 and 122', respectively, which have a diameter slightly less than the diameter of second shaft members 121 and 121'. Third shaft members 122 and 122' each has a length to support the width of a respective one of the first, second, or third sets of the plurality of belts 44, 45, and 46 (FIG. 1) coupled thereto via rotary discs (only 47*b*, 47*b'*, 47*c*, 47*c'* shown) (FIG. 2). In the preferred embodiment, bearings (not shown) housed in bearing housings 123 and 123' are ball bearings. In the exemplary embodiment, double-row self-aligning ball bearings, manufactured by FAG, Model No. GUB2217K were used and a Mether bearing housing, Model No. FCS22517 was used. Double-row self-aligning roller bearings were tried in the present invention; however, these bearings overheated, I believe, because of an insufficient side load.

First shaft member 120 has coupled thereon a plurality of sleeves 50 wherein each of the sleeves 50 is equally spaced along the length of first shaft member 120. Each of the sleeves 50 has mounted thereto swinging dual-blade member 71 and identical swinging dual-blade member 72 whereby each of the swinging dual-blade members 71 and 72 are equally spaced around the circumference of sleeve 50. Since the swinging dual-blade members 71 and 72 are identical, only one such swinging dual-blade member will be described in detail.

Figure 7:
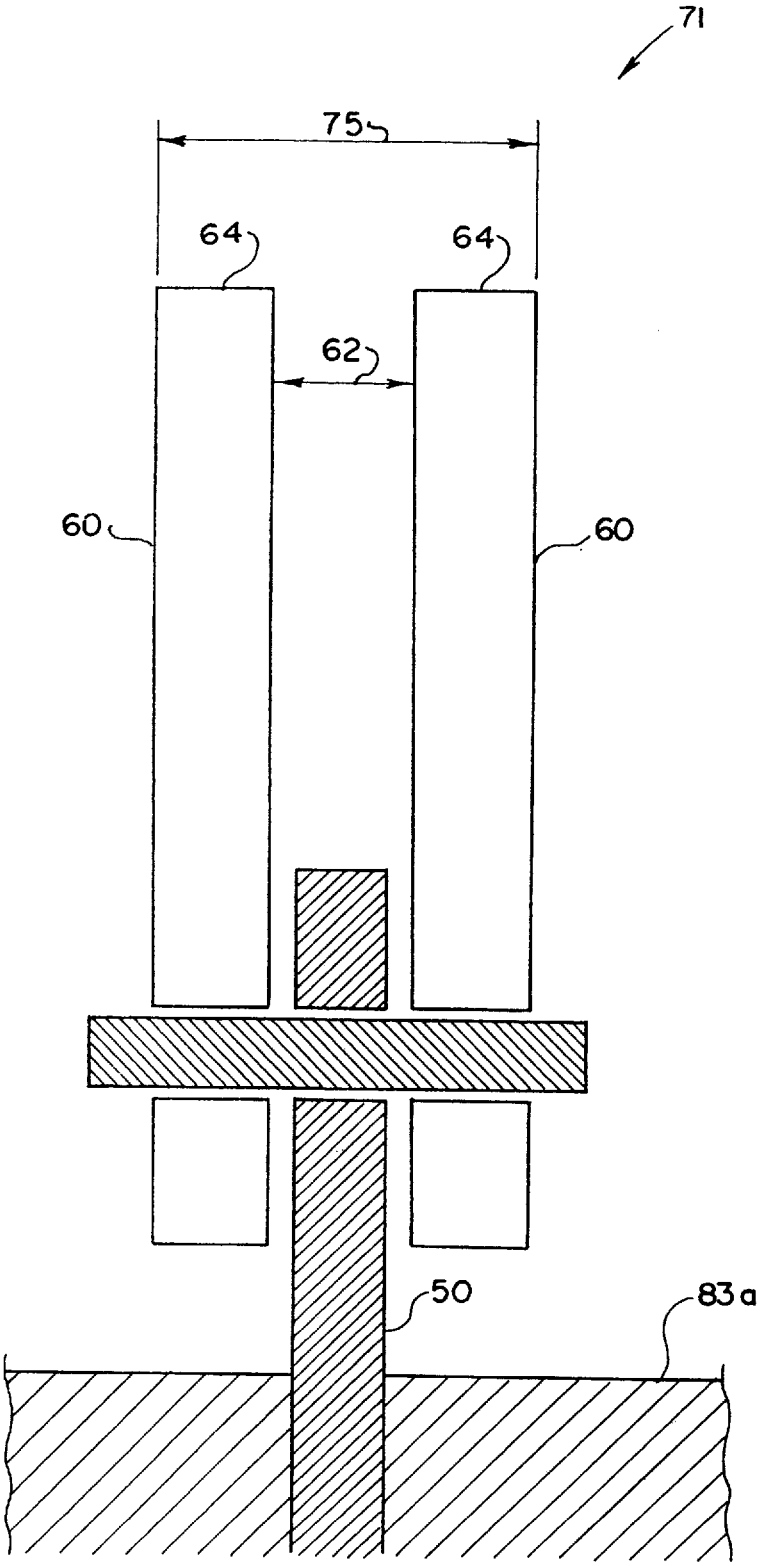
FIG. 7 illustrates a view of the swinging dual-blade member of the present invention of FIG. 6.

Referring also to FIG. 7, a view of the swinging dual-blade member of the present invention is illustrated. Swinging dual-blade member 71 comprises a pair of blades 60, in parallel, which are swingably and independently coupled to sleeve 50 with a gap 62 between the pair of parallel blades 60 wherein, as rotary shaft 83*a* is rotated at high speeds, the pair of parallel blades 60 become radially aligned with rotary shaft 83*a*. The pair of parallel blades 60 are independent and swing independent of each other. The swinging and independent attributes of blade-to-sleeve coupling serve to enhance, in operation, the lifting and flinging of the comminutable material, as well as, reduce the risk of blade failure. For example, if one of the blades of the pair of parallel blades 60, in operation, encounters an obstacle (such as a large load of the material), the swingable attribute assists in preventing said blades from shearing or otherwise failing as would a fixedly mounted blade. I use the term "rotary blade" herein as a general term to refer to blade pair 60, or to a single blade of blade pair 60 or to any blade or combination of blades coupled to a rotor or other rotary driven shaft.

When comminuting comminutable material such as rock, drilling material or other such hard material, the blades of the pair of blades 60 are worn over time. Hence, the impact surfaces of the blades of the pair of blades 60 may be modified to have coupled thereto a replaceable wear cap to extend the useful life of the blades.

The blades of the pair of parallel blades 60 each have a blade end surface 64 wherein the radial distance 63 (FIG. 3) from the blade end surface 64 to the axis of rotary shaft 83*a* is slightly less than radius 13 so that, in operation, blade end surface 64 of the pair of parallel blades 60 do not strike or drag over the interior surface area of comminution chamber 82 or single rectangular breaker bar 84. Swinging dual-blade member 72, identical to swinging dual-blade member 71, is also mounted on each sleeve 50 at a location 180° from swinging dual-blade member 71 such that, when rotary shaft 83*a* is rotated at high speeds, the blades of parallel blade pair 60 of swinging dual-blade member 72 likewise become radially aligned with rotary shaft 83*a* and serve to essentially centrifugally balance the radial load experienced by shaft 83*a* with that of swinging dual-blade member 71. In the exemplary embodiment, swinging dual-blade members 71 and 72 spaced 180° from each other are illustrated. Nevertheless, the use of three or four, rather than two, identical swinging dual-blade members 71 and 72 may be used on sleeve 50 in which the spacing on sleeve 50 between the swinging dual-blade members is 120° or 90°, respectively, rather than 180° in order to achieve centrifugal balance. Nevertheless, any number of identical swinging dual-blade members equally spaced on sleeve 50 in order to achieve centrifugal balance may be substituted. The balanced pair of swinging dual-blade members 71 and 72 on sleeve 50 is sometimes hereinafter referred to as rotary lifter 73 for rotary shaft 83*a*.

Referring again to FIG. 6, rotary shaft 83*a*' has rotatably coupled thereon a plurality of swinging dual-blade members 71' and 72' wherein each of the swinging dual-blade members 71' and 72' are equally spaced along the length of first shaft member 120 of rotary shaft 83*a*' via sleeve 50'. The balanced pair of swinging dual-blade members 71' and 72' on sleeve 50' is hereinafter referred to as rotary lifter 73' for rotary shaft 83*a*'.

The axial location of rotary lifter 73 on rotary shaft 83*a* is, when compared with rotary 73' on rotary shaft 83*a*', axially offset by distance 74 such that, in operation, the blades of parallel blade pair 60 of rotary lifter 73 do not engage said blades of rotary lifter 73'. Also, the distance 74 is sufficient to insure that comminutable material is not subjected to direct grinding between the blades of rotary lifter 73 and the blades of rotary lifter 73'. The arrangement of the pair of rotary lifters 73 and 73' relative to each other on rotary shafts 83*a* and 83*a*', respectively, is said to be "complementary mounted." Multiple pairs of rotary lifters 73 and 73', each pair complementary mounted, can be located along rotary shafts 83*a* and 83*a*', respectively, depending on the overall throughput needs.

In the exemplary embodiment of the invention, six pairs of rotary lifters 73 and 73', each pair complementary mounted, are located on rotary shafts 83*a* and 83*a*' in tierable, modular comminution chamber 80*a*. Nevertheless, the number of pairs of rotary lifters 73 and 73' is a function of the length of first shaft member 120 of rotary shafts 83*a* and 83*a*' proportionate to the length of tierable, modular comminution chamber 80*a*.

Figure 17:
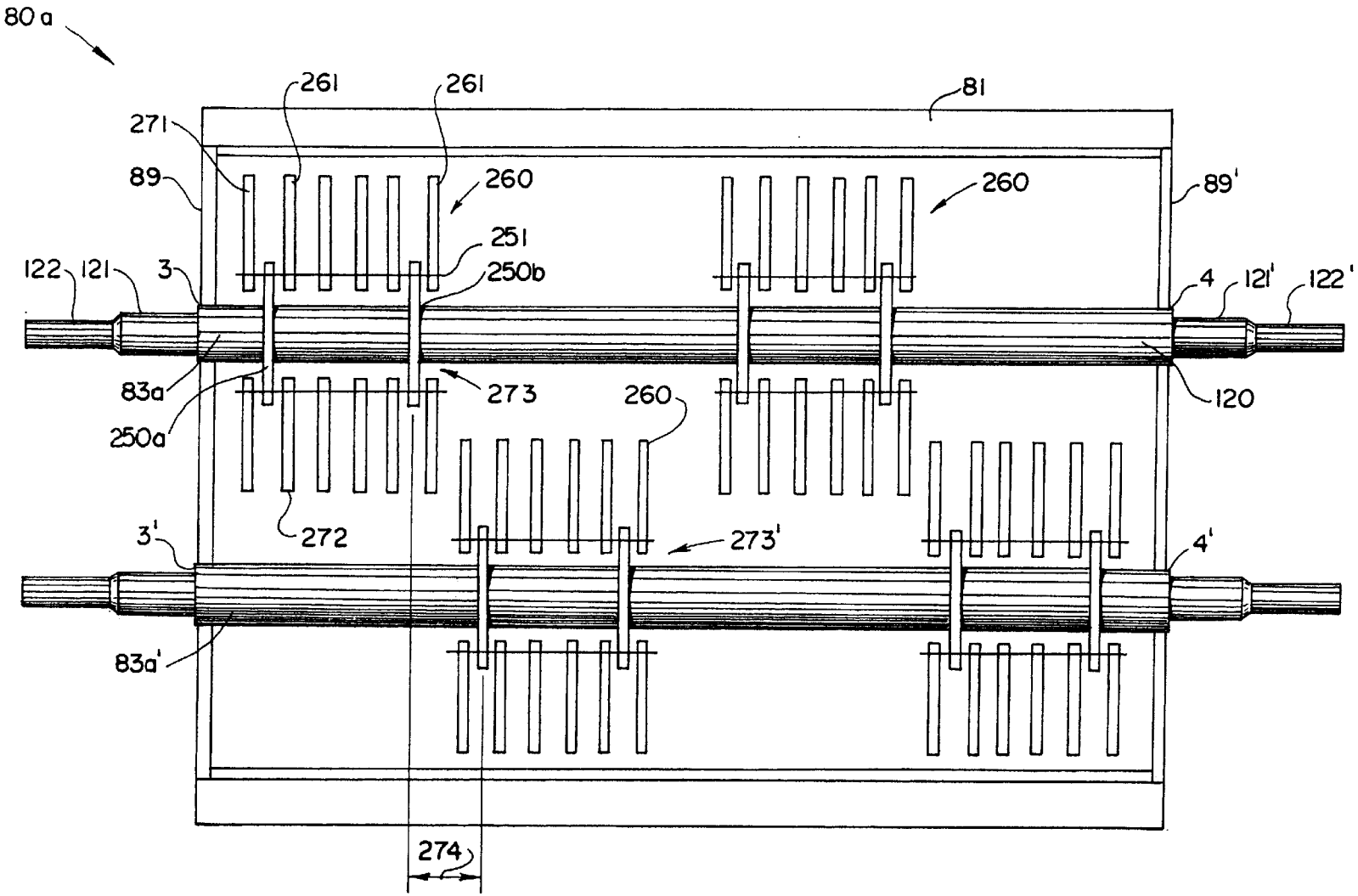
FIG. 17 illustrates an inside bottom view of an alternative arrangement of the swinging blade pair for use in the tierable, modular comminution chamber of the present invention.

Referring now to FIG. 17, an inside bottom view of an alternative arrangement of the swinging blade pair is illustrated. When comminuting fibrous material it is desirable to modify the pair of blades 60 with a plurality of parallel blades 260 having a thickness significantly less than the thickness of each blade of the pair of blades 60 such that the fibrous material is shredded and cut by the plurality of parallel blades 260. Moreover, the fibrous material is further comminuted by impact within comminution chamber 82. Typically, fibrous material does not always maintain the flow in the orbital paths of barrels 85*a* and 85*a*'. Henceforth, I have determined that the blades of the plurality of parallel blades 260 should be shorter than the blades of the pair of blade 60. Alternatively, the blades of the plurality of parallel blades 260 may have staggered lengths and/or thicknesses. Furthermore, the plurality of parallel blades 260 may be modified such that some or all of the blades are fixedly coupled to swing as a group and those not in the group swing independently. However, any blade configurations must be balanced.

The plurality of parallel blades 260 comprises two swinging dual-blades 261 coupled to sleeves 250*a* and 250*b*, respectively, and at least one other swinging blade evenly distanced therebetween via joining rod 251. Depending on the type of fibrous material, one or more swinging blades may be evenly distanced between the two swinging dual-blades 261 for facilitating the shredding and cutting of such fibrous material. Swinging multi-blade member 271 comprises the plurality of blades 260, in parallel, which are swingably and independently coupled to sleeve 250*a* and 250*b*. All blades are spaced from the other such that as rotary shaft 83*a* is rotated at high speeds, the plurality of blades 260 become radially aligned with rotary shaft 83*a*. The swinging and independent attributes of blade-to-sleeve coupling serve to enhance, in operation, shredding, as well as, lifting and flinging of the fibrous material. Swinging multi-blade member 272, identical to swinging multi-blade member 271, is also mounted to sleeves 250*a* and 250*b* at a location 180° from swinging multi-blade member 271 such that, when rotary shaft 83*a* is rotated at high speeds, the blades of the plurality of blades 260 of swinging multi-blade member 272 likewise become radially aligned with rotary shaft 83*a* and serve to essentially centrifugally balance the radial load experienced by shaft 83*a* with that of swinging multi-blade member 271. Nevertheless, the use of any number of identical swinging multi-blade members 271 may be substituted in a balanced configuration (for example three swinging multi-blade members 271 may be spaced 120° apart). The balanced pair of swinging multi-blade members 271 and 272 on sleeves 250*a* and 250*b* is sometimes hereinafter referred to as multi-blade rotary lifter 273 for rotary shaft 83*a*.

Identical swinging multi-blade rotary lifter 273' on rotary shaft 83*a*' is, when compared with multi-blade rotary lifter 273 on shaft 83*a*', axially offset by distance 274 such that, in operation, the blades of the plurality of parallel blades 260 of multi-blade rotary lifter 273 do not engage the plurality of parallel blades 260 of multi-blade rotary lifter 273'.

Alternatively, a blade of the pair of blades 60 may be removed such that a single blade is spaced 180°, 120°, 90°, etc. from at least one other single blade. Nevertheless, when removing a blade the blade configuration must be balanced.

Referring again to FIG. 3, power rotation system 40 (FIG. 1) rotates rotary shafts 83*a* and 83*a*' in a counter-rotating fashion. The rotary lifters 73 and 73' scoop and lift the comminutable material from the barrel bellies 86 and 86', respectively, and fling said comminutable material toward first and second split rectangular breaker bar members 84' and 84". The comminutable material collides with surface areas 115 and 115' of first and second split rectangular breaker bar members 84' and 84", respectively. Simultaneously, a flow of comminutable material feeds into comminution chamber 82 via said material inlet port and fissure 88 (FIG. 3) and is distributed between the counter orbital paths.

The second symmetrical pair of wall segments of the plurality of symmetrical pairs of wall segments of modular housing structure 81 forming barrel bellies 86 and 86' comprises screen members 130 and 130' which generally extend the length of tierable, modular comminution chamber 80*a*, for passing therethrough comminuted material dimensioned to exit comminution chamber 82. Since the screen members 130 and 130' are identical, only one such screen member will be described in detail.

Figure 8A:
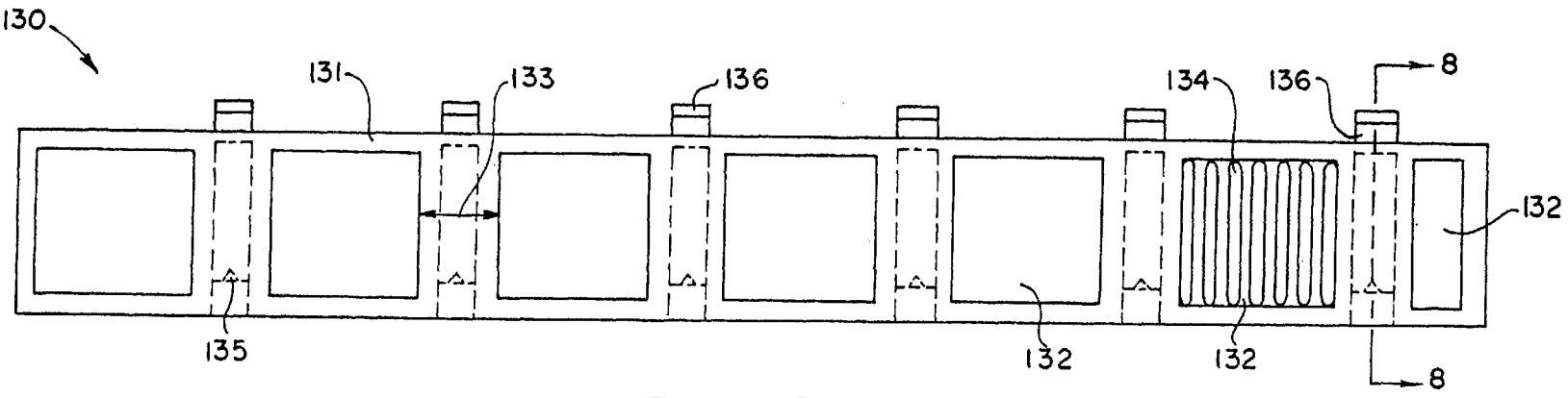
FIG. 8*a* illustrates a top view of the screen member of the present invention.

Referring to FIG. 8*a*, a top view of the screen member of the present invention is shown. Screen member 130 has a rectangularly shaped outer perimeter wherein screen surface area 131, defined within the outer perimeter of screen member 130, is slightly concaved, as shown in FIG. 8*c*, to conform to the contour of barrel bellies 86 and 86'. I have determined that as rotary shaft 83*a* is rotated at high speeds and the pair of parallel blades 60 become radially aligned with rotary shaft 83*a*, due to the addition of comminutable material, there is wearing of screen surface area 131. The wearing of screen surface area 131 was aligned with each pair of parallel blades 60. As a result, screen member 130 is designed to comprise a plurality of equally spaced filtering screen areas 132 each of which is separated by distance 133. The concaved surface area of screen surface area 131 defined by distance 133 is hereinafter referred to as screen free space. Distance 133 is proportionate to width 75 (FIG. 7) of swinging dual-blade members 71 or 72 wherein width 75 is a function of the width of each blade of the pair of blades 60, in parallel, and gap 62 therebetween. Henceforth, the integrity of the plurality of filtering screen areas 132 is maintained during the rotation of rotary shaft 83*a* at high speeds.

Each of the filtering screen areas 132 have formed therein a plurality of filtering apertures 134 having a size to pass therethrough comminuted material of a desired dimension. In the exemplary embodiment, each filtering aperture of the plurality of filtering apertures 134 is shaped in the form of a slot; however, any suitable aperture formation for passing therethrough comminuted material of the desired dimension may be substituted.

Figure 18:
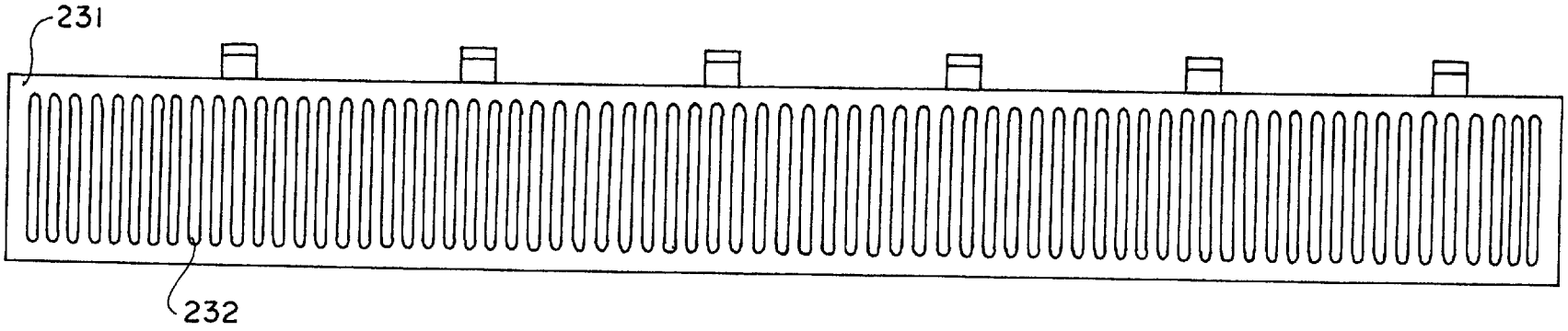
FIG. 18 illustrates an alternative embodiment of the screen member of the present invention.

As shown in FIG. 18, an alternative embodiment of the screen member is illustrated. The screen surface area 231 has formed therein filtering screen area 232 distributed throughout the screen surface area 231 (absent any screen free space) thereby maximizing the total filtering screen surface area.

Figure 8B:
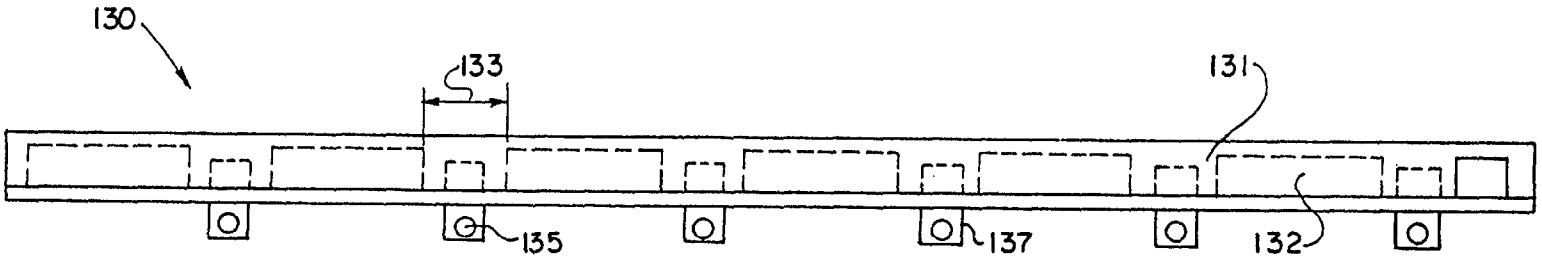
FIG. 8*b* illustrates a side view of the screen member of FIG. 8*a;*
Figure 8C:
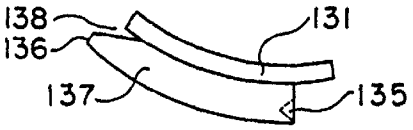
FIG. 8*c* illustrates a cross-sectional view of the screen member along the plane of 8—8 of FIG. 8*a;*

Referring to FIGS. 8*b* and 8*c*, a side view and cross-sectional view along the plane 8—8 of the screen member are illustrated. The bottom surface of each said screen free space has fixedly coupled thereto screen securing bar 137. One distal end of each screen securing bar 137 has formed therein screen aperture 135. The other distal end of each screen securing bar 137 is structured to form screen member notch 138 beginning below the bottom surface of screen surface area 131 and a portion 136 of each screen securing bar 137 extends beyond screen surface area 131.

Alternatively, the modular housing wall structure 81 (having a plurality of symmetrical pairs of wall structure segments, bottom center material guide member 150 and end side wall structures 89 and 89') is capable of omitting screen members 130 and 130' from at least one of the plurality of tierable, modular comminution chambers 80*a*, 80*b*, and 80*c*. Therefore, comminuted material of any size will exit each of the plurality of tierable, modular comminution chambers 80*a*, 80*b*, and 80*c* without classification. In the case where all of the plurality of tierable, modular comminution chambers omit screen members 130 and 130', the comminuted material exiting at least the final stage comminution chamber can be classified and material requiring further comminution can be recycled back into the first stage comminution chamber in a conventional manner.

Referring again to FIG. 3, the slightly overlapping feature of barrels 85*a* and 85*a'* forms apex 159 wherein barrel belly 86 discontinues at apex 159 and barrel belly 86' begins at apex 159. Bottom center material guide member 150 of modular housing wall structure 81 is a quasi-triangular shaped member which extends the length of tierable, modular comminution chamber 80*a*. Bottom center material guide member 150 has an apex which conforms to the contour of apex 159 and its symmetrical side surface edges conform to the contour of barrel bellies 86 and 86', respectively. A bottom portion of each said symmetrical side surface edges have formed therein guide member notches 152 and 152', respectively. Guide member notches 152 and 152' receive therein a portion of screen surface area 131 and 131', respectively, of screen members 130 and 130', respectively. Bottom curved surface edge 153 of bottom center material guide member 150 has coupled in the center thereof center bar member 154. Each distal end of center bar member 154 comprises a plurality of apertures 155 for securing to end walls 89 and 89' respectively, via a plurality of securing means (not shown) thereby preventing bottom center material guide member 150 from shifting left or right and misalignment.

Bottom center material guide member 150 divides comminution chamber 82 into barrels 85*a* and 85*a'* wherein bottom center material guide member 150 directs the flow of comminuted and comminutable material in comminution chamber 82. Henceforth, said apex and said symmetrical side surface edges of bottom center material guide member 150 are subject to wearing and degradation overtime.

Figure 19:
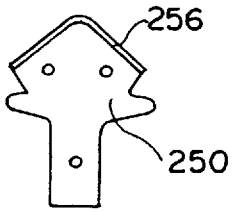
FIG. 19 illustrates an alternative embodiment of the bottom center material guide member of the present invention.

Referring now to FIG. 19, an alternative embodiment of the bottom center material guide member is shown. Bottom center material guide member 250 is designed such that a portion of said apex and a portion of said symmetrical side surfaces are reduced and the reduced portions are replaced with replaceable wear cap member 256 made of durable material. Therefore, instead of replacing bottom center material guide member 150, only replaceable wear cap member 256 of bottom center material guide member 250 will be replaced, as needed.

Referring again to FIG. 3, screen notches 138 and 138' of screen securing bars 137 and 137', respectively, each receives therein symmetrical bottom portions of bottom center material guide member 150 below guide member notches 152 and 152', respectively, such that extending portions 136 and 136' of screen securing bar 137 and 137', respectively, abut against opposite sides of bottom curved surface edge 153 via screen notches 138 and 138', respectively.

Immediately adjacent screen members 130 and 130' are injection inlet connecting structures 148 and 148', respectively, wherein injection inlet connecting structures 148 and 148' are the third symmetrical pair of wall segments of the plurality of symmetrical pairs of wall segments. Injection inlet connecting structures 148 and 148 have coupled thereto parallel injection inlet conduits 140 and 140', respectively, positioned slightly below said screen members 130 and 130', respectively, for providing two parallel flushing apparatuses to enhance material mobility between each of the plurality of tierable, modular comminution chambers 80*a*, 80*b*, and 80*c*. Injection inlet conduits 140 and 140' each extend the length of modular chamber 80*a* for passing therethrough water, air, steam, a fluid chemical mixture or the like. Further reference to water, air, steam, a fluid chemical mixture or the like will sometimes hereinafter be referred to as "the injection stream". Since injection inlet conduits 140 and 140' are identical, only one such injection inlet conduit will be described in detail.

Figure 9A:
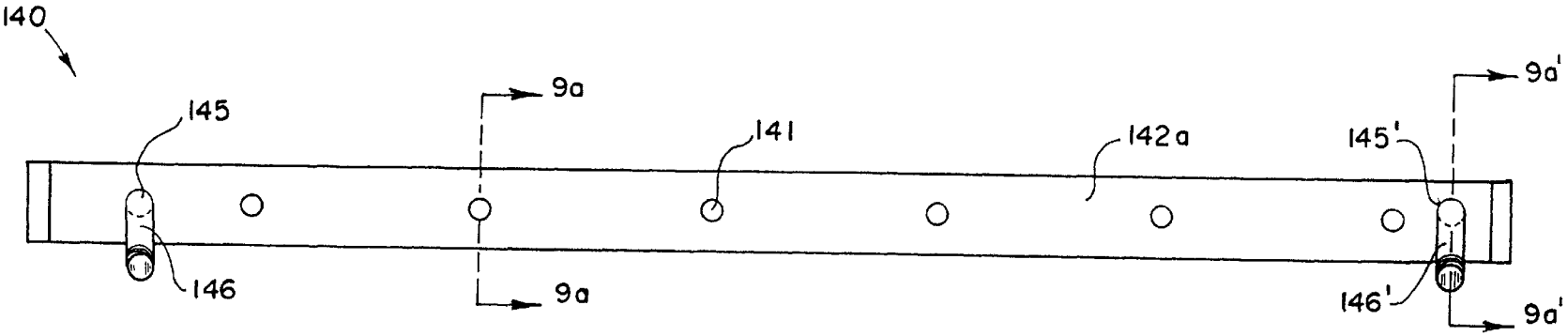
FIG. 9*a* illustrates a front view of the injection inlet conduit of the present invention.

Referring to FIG. 9*a*, a front view of the injection inlet conduit of the present invention is illustrated. Injection inlet conduit 140 has formed therein a plurality of apertures 141 formed in parallel sides 142*a* and 142*b* for passing therethrough rod member 143, as shown in cross-section along the plane 9*a*—9*a*, in FIG. 9*c*. Each aperture of the plurality of apertures 141 is spaced to align with each of the screen apertures 135 (FIG. 8*b*) formed in each screen securing bar 137.

Figure 9B:
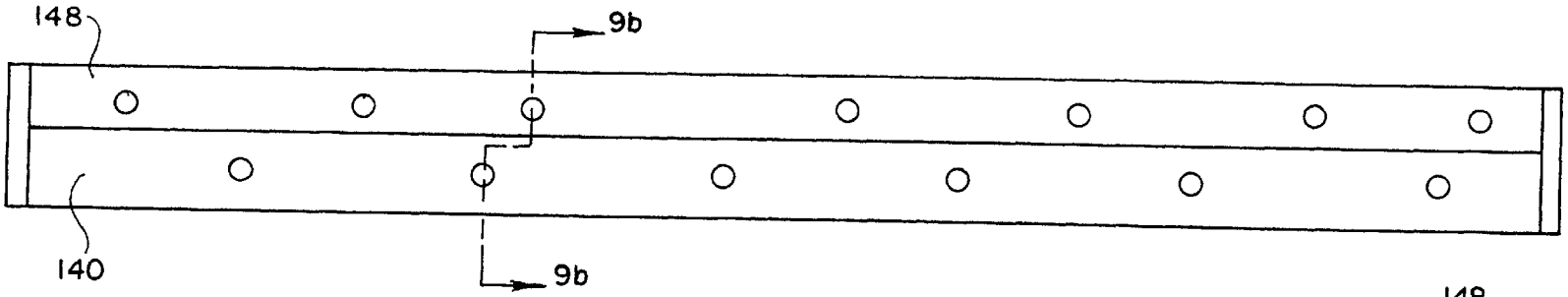
FIG. 9*b* illustrates a front view of the injection inlet conduit and injection inlet conduit connecting structure of the present invention.
Figure 9E:
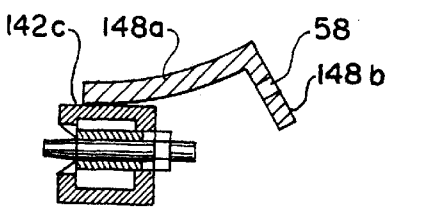
FIG. 9*e* illustrates a cross-sectional view of the injection inlet conduit and injection inlet conduit connecting structure along the cross section of 9*b*—9*b* of FIG. 9*b;*
Figure 9D:
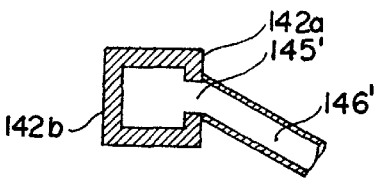
FIG. 9*d* illustrates a cross-sectional view of the injection inlet conduit along the plane of 9*a*'—9*a*' of FIG. 9*a;*
Figure 9C:
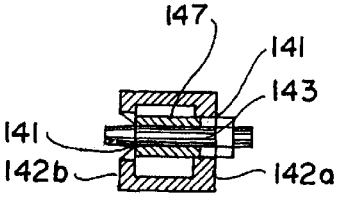
FIG. 9*c* illustrates a cross-sectional view of the injection inlet conduit along the plane of 9*a*—9*a* of FIG. 9*a;*

As shown in FIG. 9*c*, one distal end of rod member 143 protrudes from side 142*b* for coupling into screen apertures 135 (FIG. 3). The interior of injection inlet conduit 140 has fixedly coupled thereto rod member conduit 147, aligned with aperture 141, for receiving therein rod member 143.

Rod member conduit 147 is unitarily formed with the interior surface of parallel sides 142*a* and 142*b*, respectively, thereby forming a water/air tight conduit for receiving therein rod member 143. As shown in FIG. 3, as screen members 130 and 130' abut against bottom curved surface edge 153 and rod members 143 and 143' are received in screen apertures 135 and 135', respectively, of said one distal end of screen securing bars 137 and 137', respectively, screen members 130 and 130' are thereby secured. Henceforth, the unique securing of screen members 130 and 130', as described above, allows screen members 130 and 130' to be easily attached and detached from modular housing wall structure 81. Moreover, bottom center material guide member 150, screen members 130 and 130' and injection inlet conduits 140 and 140' are modularly coupled to form the bottom contour of barrel bellies 86 and 86' of tierable, modular comminution chamber 80*a*.

Referring to FIG. 9*d*, a cross-sectional view along the plane of 9*a*'—9*a*' of the injection inlet conduit is shown. Each end of injection inlet conduit 140 has formed therein injection outlet aperture 145 and injection inlet aperture 145' for coupling to one distal end of injection piping members 146 and 146', respectively. As shown in FIG. 1, the other distal end of injection piping member 146 is capped off for flushing and cleaning injection inlet conduit 140. As shown in FIG. 2, the other distal end of injection piping 146' wraps around the side of tierable, modular comminution chamber 80*a* and extends the length thereof. The other distal end of injection piping 146' couples to chamber injection inlet connector 90*a* (FIG. 2) for receiving therein the injection stream from injection distribution system 190. As the injection stream is received in injection piping 146', the injection stream fills injection inlet conduits 140 and 140'.

Figure 9F:
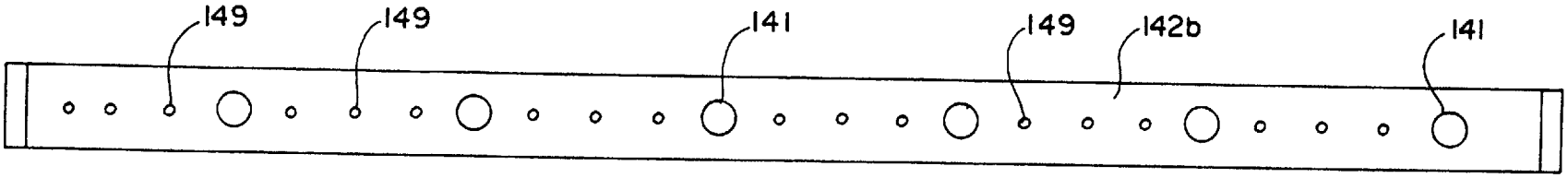
FIG. 9*f* illustrates a back view of the injection inlet conduit of the present invention.

Referring to FIG. 9*f*, a back view of the injection inlet conduit is illustrated. Side 142*b* has a plurality of injection outlet spray apertures 149 spaced between each aperture of the plurality of apertures 141. The plurality of injection outlet spray apertures 149 are grouped into a plurality of three adjacent complementary apertures wherein the second aperture of the three outputs a stream at 90 degrees, the first and third apertures, immediately to the left and right, output a stream at 45 degrees from said second aperture. The plurality of injection outlet spray apertures 149 apply a force of pressure to the comminuted material such that the comminuted material exiting screen member 130 is guided downward in the transfer conduit for enabling the comminuted material to free fall into fissure 88 via said material inlet port of the succeeding stage comminution chamber.

Referring to FIG. 9*b*, a front view of the injection inlet conduit and injection inlet conduit connecting structure of the present invention is illustrated. Injection inlet conduit connecting structure 148 has fixedly coupled thereto top surface 142*c* of injection inlet conduit 140. As illustrated in FIG. 9*e*, a cross-sectional view along the cross section of 9*b*—9*b*, injection inlet connecting structure 148 comprises injection inlet connecting structure top surface 148*a* shaped to the contour of barrel bellies 86 or 86' and support member 148*b* coupled substantially perpendicularly to one distal end of injection inlet connecting structure top surface 148*a*. The other end of injection inlet connecting structure top surface 148*a* abuts against a surface edge of screen surface area 131, as shown in FIG. 3. Support member 148*b* has formed therein a plurality of apertures 58 for securing door support surface 210*b* (FIG. 13) thereto via a plurality of securing means (not shown).

Figure 20:
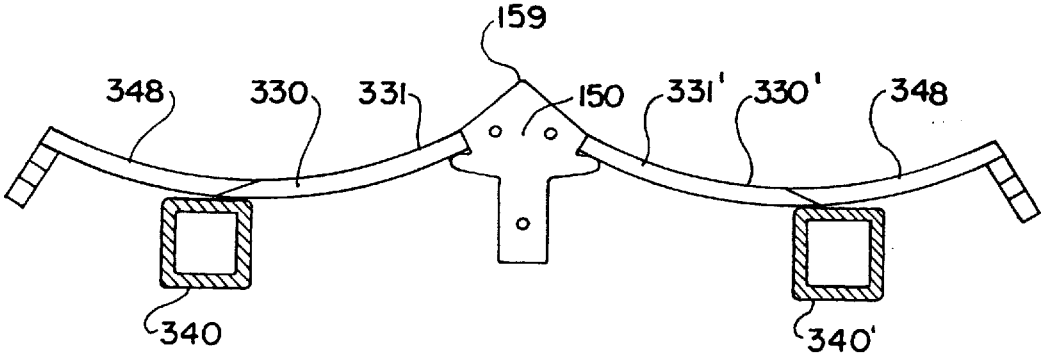
FIG. 20 illustrates a partial end view of an alternative embodiment of the bottom contour of the tierable, modular comminution chamber of the present invention.

Referring to FIG. 20, a partial end view of an alternative embodiment of the bottom contour of the tierable, modular comminution chamber is illustrated. Screen members 330 and 330' omit screen securing bars 137 and 137'. Moreover, a portion of the top surface of screen surface areas 331 and 331' adjacent injection connecting structure 348 and 348', respectively, are sloped downward. Each of the injection connecting structures 348 and 348' comprise an extension surface wherein the bottom surface of such extension surfaces are sloped upward. When the sloped surfaces of screen surface areas 331 and 331' are received under their respective sloped bottom surface of the extension surfaces, screen members 330 and 330' are secured in place. Additionally, injection inlet conduits 340 and 340' are modified such that rod members 143 and 143' and rod member conduit 147 and 147' are omitted. Henceforth, injection inlet conduits 340 and 340' provide a clear unobstructed tunnel for the flow of the injection stream therein.

Modularly tiered clear-trajectory impact comminuter apparatus 10 of FIG. 1, comprises a plurality of tierable, modular comminution chambers 80*a*, 80*b*, and 80*c*. In the exemplary embodiment, there are three tierable, modular comminution chambers 80*a*, 80*b*, and 80*c* modularly, vertically coupled in series. Nevertheless, depending on the type of comminutable material to be comminuted in modularly tiered clear-trajectory impact comminuter apparatus 10, any number of vertically tierable, modular comminution chambers may be used to produce the desired comminuted material throughput. As described above in relation to tierable, modular comminution chamber 80*a*, all other tierable, modular comminution chambers 80*b* and 80*c* are identical thereby enhancing the manufacturing process thereof. The same cast molding or metal rolling or bending tooling design for each symmetrical pair of wall segments of the plurality of symmetrical pairs of wall segments of tierable, modular comminution chamber 80*a* may be used for tierable, modular comminution chambers 80*b* and 80*c*.

Referring to FIGS. 2 and 3, in operation, tierable, modular comminution chamber 80*a* continuously receives comminutable material via material intake duct 100. Tierable, modular comminution chamber 80*a* is hereinafter referred to as the first stage comminution chamber. Said comminutable material is fed through fissure 88 formed in single rectangular breaker bar 84 via said material inlet port. The comminutable material is distributed into barrels 85*a* and 85*a*', respectively, in cooperation with the counter-exerted centrifugal forces formed by the counter rotation of rotary shafts 83*a* and 83*a*'. The comminutable material orbits barrels 85*a* and 85*a*' and impacts first and second split rectangular breaker bar members 84' and 84", respectively, of barrels 85*a* and 85*a*'. The comminutable material is continuously comminuted in barrels 85*a* and 85*a*' until the comminuted material can exit the output of said first comminution chamber via screen members 130 and 130'. Comminuted material dimensioned to filter through screen members 130 and 130' proportionate to the dimensions of the plurality of filtering apertures 134 exit from screen members 130 and 130' of said first stage comminution chamber. As the comminuted material exits screen members 130 and 130', the comminuted material is mixed with and assisted in its movement by the injection stream from the plurality of injection outlet spray apertures 149 of injection inlet conduits 140 and 140', respectively, in the first stage transfer conduit.

Said comminuted material continuously feeds into tierable, modular comminution chamber 80*b* via fissure 88 formed in single breaker bar 84 via the material inlet port. Tierable, modular comminution chamber 80*b* is hereinafter referred to as the succeeding stage comminution chamber.

The entered comminuted material becomes comminutable material of said succeeding comminution chamber. The comminutable material is distributed into barrels 85*b* and 85*b*', respectively, in cooperation with the counter-exerted centrifugal forces formed by the counter rotation of rotary shafts 83*b* and 83*b*'. The comminutable material orbits barrels 85*b* and 85*b*' and impacts first and second split rectangular breaker bar members 84 and 84', respectively, of barrels 85*b* and 85*b*'. The comminutable material is continuously comminuted in barrels 85*b* and 85*b*' until the comminuted material can exit the output of said succeeding comminution chamber via screen members 130 and 130'.

Comminuted material dimensioned to filter through screen members 130 and 130' proportionated to the dimensions of the plurality of filtering apertures 134 wherein the plurality of filtering apertures 134 are dimensioned to pass therethrough comminuted material dimensioned smaller than that of the previous screen members 130 and 130' of the preceding comminution chamber exit through screen members 130 and 130' of said succeeding comminution chamber. As the comminuted material exits screen members 130 and 130', the comminuted material is mixed with and assisted in its movement by the injection stream from the plurality of injection outlet spray apertures 149 of injection inlet conduits 140 and 140', respectively, in the second stage transfer conduit.

Said comminuted material of said succeeding comminution chamber continuously feeds into tierable, modular comminution chamber 80*c* via fissure 88 formed in single breaker bar 84 via the material inlet port. Tierable, modular comminution chamber 80*c* is hereinafter referred to as the final stage comminution chamber. The entered comminuted material becomes comminutable material of said final stage comminution chamber. The comminutable material is distributed into barrels 85*c* and 85*c*', respectively, in cooperation with the counter-exerted centrifugal forces formed by the counter rotation of rotary shafts 83*c* and 83*c*'. The comminutable material orbits barrels 85*c* and 85*c*' and impacts first and second split rectangular breaker bar members 84' and 84", respectively, of barrels 85*c* and 85*c*'. The comminutable material is continuously comminuted in barrels 85*c* and 85*c*' until the comminuted material can exit the output of the final stage comminution chamber via screen members 130 and 130'. Comminuted material dimensioned to filter through screen members 130 and 130' proportionated to the dimensions of the plurality of filter apertures 134 wherein the plurality of filtering apertures 134 are dimensioned to pass therethrough comminuted material dimensioned smaller than that of the previous screen members 130 and 130' of the previous comminution chamber, exit through screen members 130 and 130' of said succeeding comminution chamber. As the comminuted material exits screen members 130 and 130', the comminuted material is mixed with and assisted in its movement by the injection stream from the plurality of injection outlet spray apertures 149 of injection inlet conduits 140 and 140', respectively.

Said final stage comminution chamber is the final stage of the comminution process of modularly tiered clear-trajectory impact comminuter apparatus 10. The exited comminuted material of said final comminution chamber enters material transport system 180.

Figure 10A:
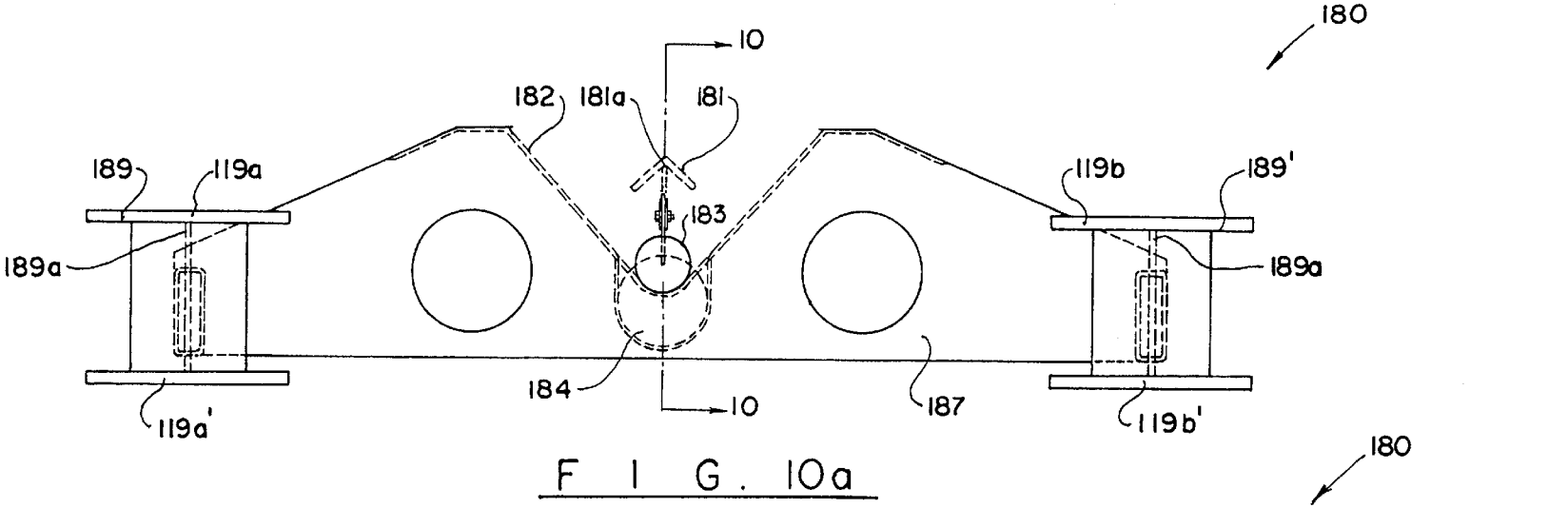
FIG. 10*a* illustrates an end view of the material transport system of the present invention.
Figure 10B:
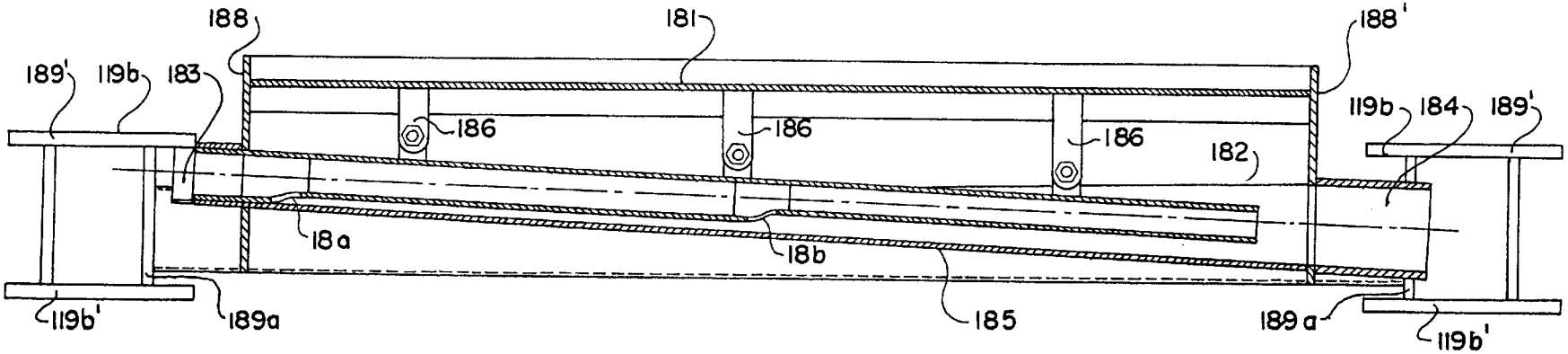
FIG. 10*b* illustrates a cross-sectional view of the material transport system along the plane 10—10 of FIG. 10*a;*

FIG. 10*a* and 10*b*, illustrate an end view and a cross-sectional view along the plane 10—10, respectively, of the material transport system of the present invention. Material transport system 180 comprises material diffuser 181, chute housing member 182, chute injection inlet port 183 and comminuted material outlet port 184. Diffuser 181 is a triangular member wherein comminuted material from the final stage comminution chamber is diffused into chute housing member 182, a sloping trough. Diffuser 181 substantially extends the length of the final stage comminution chamber and each distal end thereof is fixedly secured to two parallel end walls 188 and 188', respectively. The interior surfaces of triangular shaped diffuser 181 forms apex 181*a*. Diffuser 181 couples to chute tubing member 185 via a plurality of equally spaced supporting structures 186 wherein each supporting structure of the plurality of supporting structures 186 decreases in length. Henceforth, the bottom surface of chute tubing member 185 is slightly raised above the interior bottom surface of chute housing member 182 thereby providing an unobstructed path for the flow of the comminuted material exited from the final stage comminution chamber. Chute tubing member 185 is sloped downward and its circumference is decreased from injection inlet port 183 to comminuted material outlet port 184 in a plurality of stages. In the exemplary embodiment, the circumference of chute tubing member 185 is decreased in two stages. In the first stage, the bottom surface of chute tubing member 185 is angled to form first angled surface 18*a*. A distance from first angled surface 18*a*, the bottom surface of chute tubing member 185 is angled again to form second angled surface 18*b*. First angled surface 18*a* and second angled surface 18*b* each have a plurality of apertures (not shown) formed therein whereby as the injection stream is forced through chute tubing member 185 and chute housing member 182 via injection inlet port 183, a jet stream is also emitted through said plurality of apertures (not shown) of first angled surface 18*a* and second angled surface 18*b* into the injection stream of chute housing member 182. The force of the emitted jet stream facilitates the swift flow of comminuted material in chute housing member 182 to comminuted material outlet port 184. Moreover, the output end of chute tubing member 185 produces a siphoning effect in the injection stream of chute housing member 182 to siphon the comminuted material out through comminuted material outlet port 184.

Material transport system 180 further comprises two parallel exterior housing walls (only 187 shown), each of which is coupled to front parallel stacking stanchions 189 and back parallel stacking stanchions 189' via support members 189*a* and 189*a*', respectively. Front and back parallel stacking stanchions 189 and 189', cylindrically shaped vertical members, each has first and second support surfaces 119*a* and 119*a*' and 119*b* and 119*b*', respectively, perpendicularly coupled to each distal end thereof. First and second support surfaces 119*a* and 119*a*' and 119*b* and 119*b*', each has formed therein an aperture (not shown) formed in each corner thereof for securing the stacking stanchions of said final stage comminution chamber thereto. Henceforth, front and back parallel stacking stanchions 189 and 189' of the material transport system 180 is the foundation for modularly vertically coupling in series the plurality of tierable, modular comminution chambers 80*a*, 80*b*, and 80*c*.

The exemplary embodiment of material transport system 180 provides for a chute housing member 182 having a fluid injected therein for transport of the comminuted material out of the modularly tiered clear-trajectory impact comminuter apparatus 10 of the present invention. Nevertheless, material transport system 180 may be equipped with a conveyor belt system (without the injection stream) in lieu of chute housing member 182 having injected therein the injection stream. The conveyor belt system requiring no fluid is advantageous for environments (installation sites) which need to conserve water.

Figure 11A:
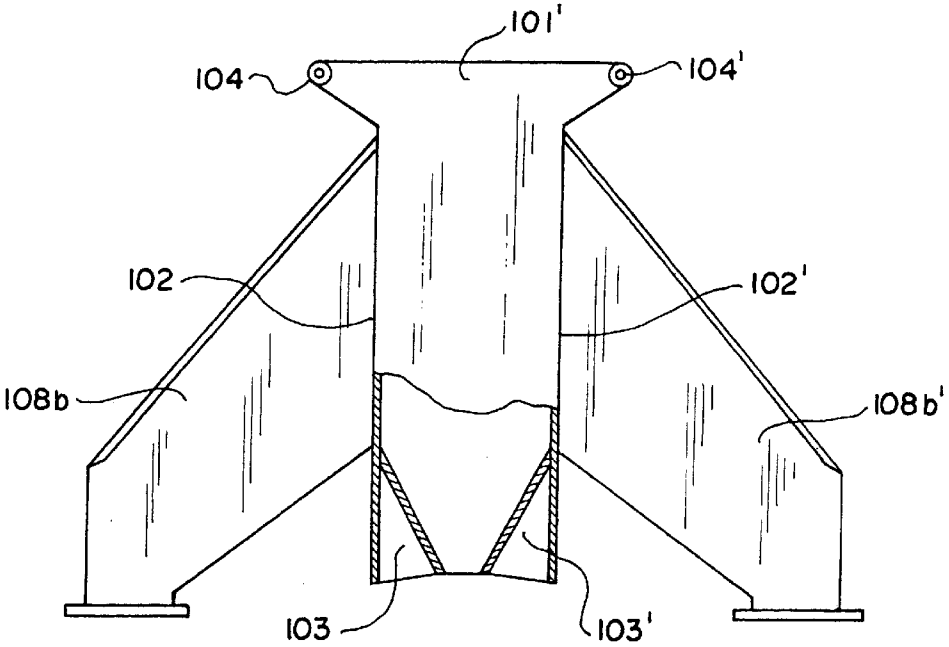
FIG. 11*a* illustrates a cross-sectional view of the material intake duct of FIG. 2.

Referring to FIGS. 1 and 2, material intake duct 100 is a substantially rectangularly shaped hollow member comprising two vertical short side walls 101 and 101' (101' shown in FIG. 11*a*) perpendicular to the axis of rotation of rotary shafts 83*a*, 83*a'*, 83*b*, 83*b'*, 83*c* and 83*c'* and two vertical long side walls 102 and 102' (102' shown in FIG. 11*a*) parallel to rotary shafts 83*a*, 83*a'*, 83*b*, 83*b'*, 83*c* and 83*c'* thereby forming an inlet conduit for receiving therein comminutable material of the installation site. As shown in FIG. 11*a*, a cross-sectional view of the material intake duct of the present invention, the bottom portions of long side walls 102 and 102' have coupled thereto material intake chute members 103 and 103', respectively. Material intake chute members 103 and 103' extend the length of long side walls 102 and 102' thereby forming a material intake chute to said material inlet port and fissure 88. The bottom surface edges of material intake duct 100 couple to near-flat roof 87 around said material inlet port of said first stage comminution chamber of modularly tiered clear-trajectory impact comminuter apparatus 10 of the present invention. The distance between the bottom edges of material intake chute members 103 and 103' is substantially equal to the width of said material inlet port thereby enabling comminutable material to free fall directly into fissure 88 via said material inlet port. Said comminutable material may by conveyed to an upper edge of material intake duct 100 via a conventional conveyor belt system (not shown) or the like. As, the conveyor belt system moves the comminutable material to said upper edge of material intake duct 100, the comminutable material is fed into said inlet conduit.

Alternatively, short side walls 101 and 101' and long side walls 102 and 102' each may be provided with a plurality of diffusers for spreading and balancing the material load entering fissure 88 via said material inlet port.

Figure 11B:
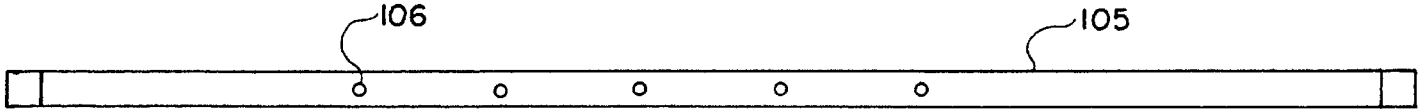
FIG. 11*b* illustrates the water spray tubing for the material intake duct of FIG. 2.
Figure 16:
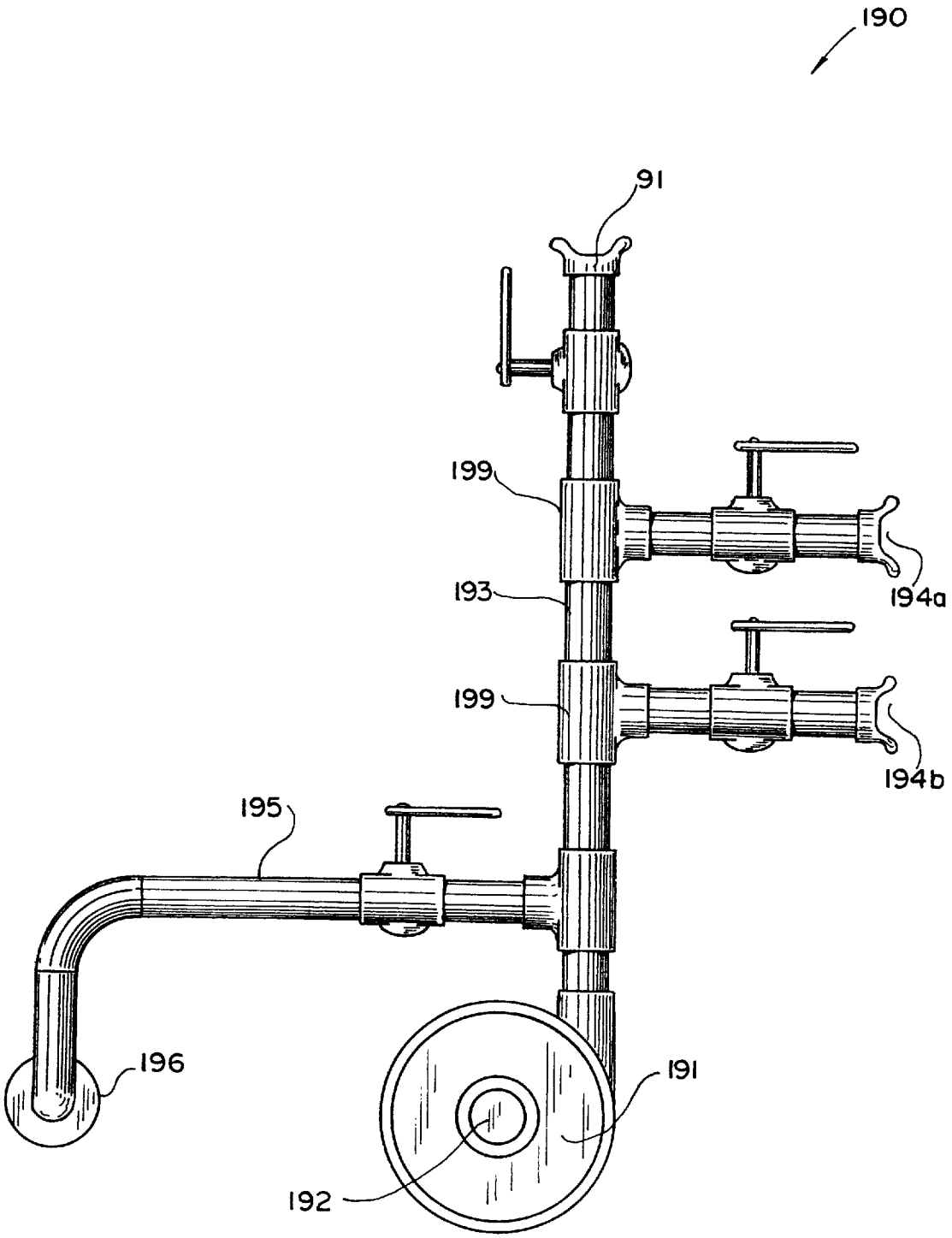
FIG. 16 illustrates an end view of the injection distribution system of the present invention.

In operation, as comminutable material of varying sizes is input into material intake duct 100, said comminutable material free falls therein. A top portion of each of the vertical long side walls 102 and 102' forms an oblique surface which forms an obtuse angle with the vertical surface of vertical long side walls 102 and 102' respectively. Each distal end of an upper portion of each said oblique surface of long side walls 102 and 102' has fixedly coupled thereto supporting rings 104 and 104', respectively, for passing therethrough injection spray tubing 105, as shown in FIG. 11*b*, which extends the length of long sides 102 and 102'. Injection spray tubing 105 comprises a plurality of stream spray apertures 106 for spraying the injection stream therefrom. The plurality of stream spray apertures 106 are slightly angled downward to direct the spray of the injection stream to each opposing long side wall for enhancing material mobility downward. One distal end of injection spray tubing 105 is capped off and the other distal end couples to intake duct stream inlet connector 107 via the connecting tubing and tee fitting 7. Intake duct stream inlet connector 107 receives the injection stream from injection distribution system 190 via material intake duct injection outlet connector 91 (FIG. 16). The comminutable material input into material intake duct 100 mixes with the injection stream and feeds through fissure 88 via said material inlet port of said first stage comminution chamber.

Figure 21:
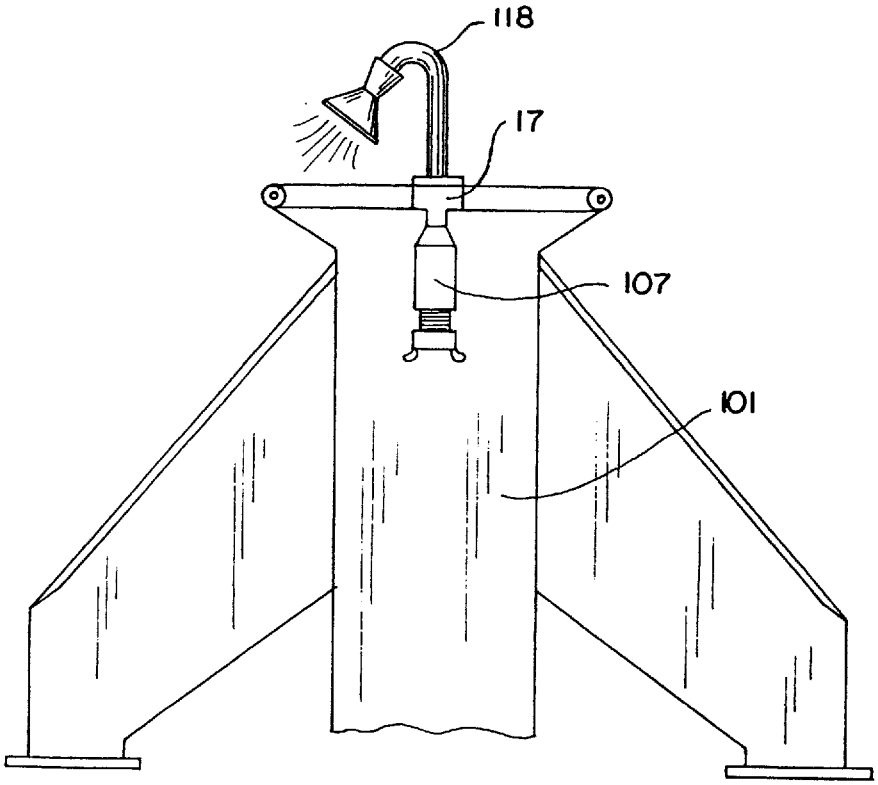
FIG. 21 illustrates another alternative embodiment of the material intake duct of the present invention.

Referring to FIG. 21, an alternative embodiment of the material intake duct is illustrated. Intake duct stream inlet connector 107 is connected to fitting 17 wherein fitting 17 has coupled thereto goose neck outlet member 118. Goose neck outlet member 118 sprays the injection stream over vertical short wall 101 and into the center of material intake duct 100 for enhancing the material mobility downward. As shown, intake duct stream inlet connector 107 and goose neck outlet member 118 are coupled in the center of vertical short wall 101 but may be positioned any where along short wall 101. Although not shown, an identical intake duct stream inlet connector and goose neck outlet member are provided on vertical short wall 101' coupled to said one distal end of injection spray tubing 105.

Material intake duct 100 further comprises four bracing members 108*a*, 108*a'*, 108*b* and 108*b'* each having an angled surface area such that one edge thereof is coupled to each vertical edge of long side walls 102 and 102', respectively, and a bottom surface of bracing members 108*a* and 108*a'* are coupled to front parallel stacking stanchions 202 and bracing members 108*b* and 108*b'* are coupled to back parallel stacking stanchions 202' for securely supporting material intake duct 100 on top of near-flat roof 87 of said first stage comminution chamber.

The varying sizes of different types of comminutable material, which is environment specific, has occasion to build up above said material inlet port. Henceforth, the comminutable material build-up slows the amount of flow of comminutable material fed into fissure 88 thereby slowing the comminution process and compromising maximum throughput. I have determined that by equipping material intake duct 100 with force feed system 160, the comminutable material will be forced into said material inlet port and fissure 88 thereby eliminating any build-up of comminutable material. Moreover, the comminution process is not slowed and maximum throughput is not compromised.

Figure 12:
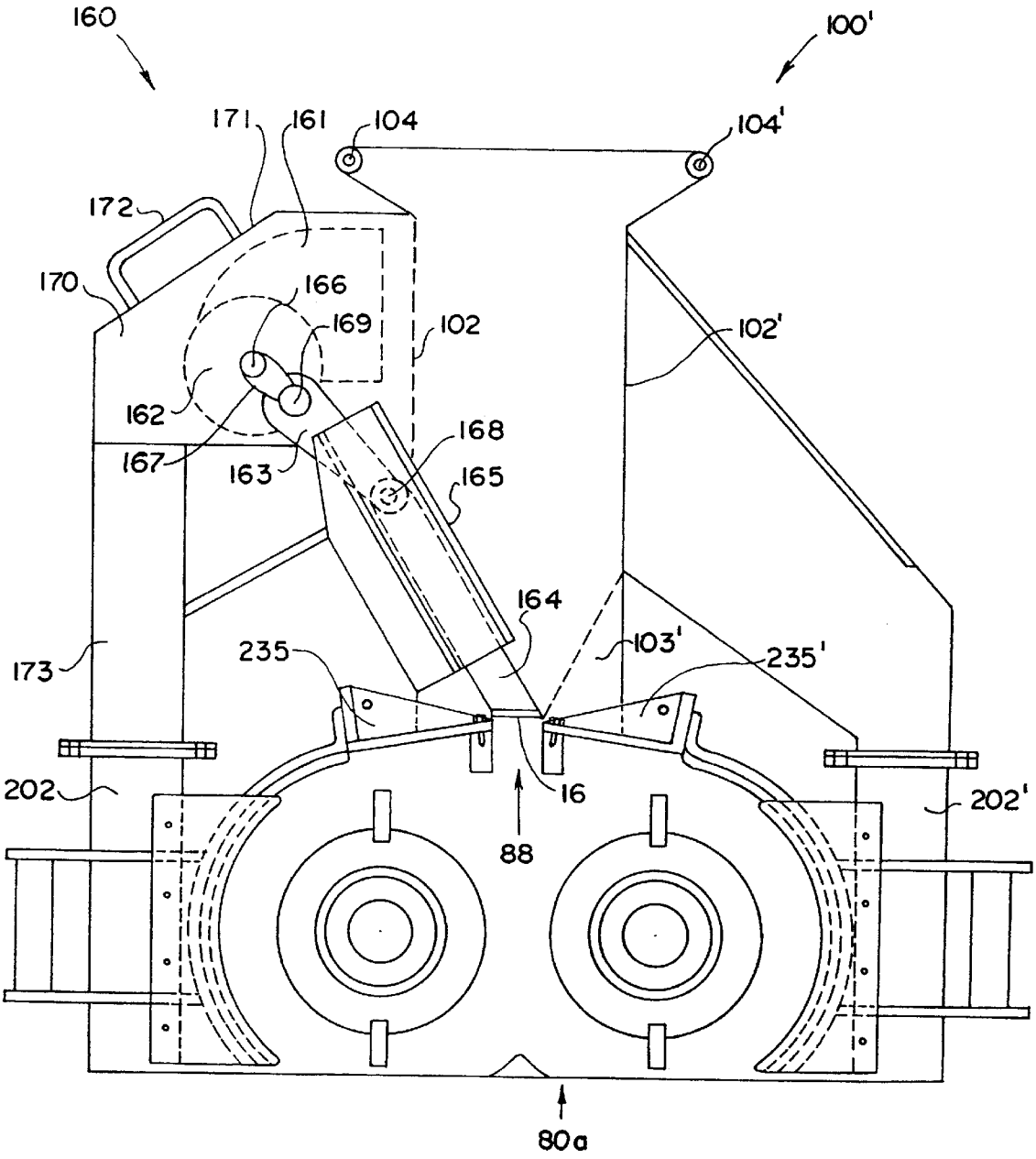
FIG. 12 illustrates a cross-sectional view of an alternative embodiment of the material intake duct connected to the first stage comminution chamber of the present invention.

Referring to FIG. 12, a cross-sectional view of an alternative embodiment of a material intake duct is illustrated. Material intake duct 100' is modified with force feed system 160. Long side wall 102 is modified with an opening for providing mechanical reciprocating mechanism 164 of force feed system 160 access into the interior of material intake duct 100'. Furthermore, a portion of material intake chute 103 is removed to provide space for angled channel structure 165 and reciprocating mechanism 164 wherein the top surface of angled channel structure 165 provides a chute for the free falling comminutable material to fissure 88. Force feed system 160 comprises intake duct motor means 161, cam member 163, mechanical reciprocating mechanism 164, angled channel structure 165 and force feed system housing 170 coupled to long wall side 102.

Mechanical reciprocating mechanism 164 comprises a plurality of parallel tubular members fixedly coupled together. The bottom surface of the plurality of parallel tubular members are angled to form a horizontal surface. The horizontal surface has coupled thereto unitary flat bar member 16. Preferably, the top surface area of the plurality of parallel tubular members is coated with TEFLON or the like.

Intake duct motor means 161 comprises a conventional motor housed in motor housing 162, shaft member 166 and cam connecting member 167. Shaft member 166 has one end coupled to said conventional motor (not shown) and its other end coupled to one end of cam connecting member 167 wherein cam connecting member 167 rotates about the axis of rotation of shaft member 166. One end of cam member 163 rotatably couples to cam connecting member 167 via hinge mechanism 169. The other end of cam member 163 couples to one end of mechanical reciprocating mechanism 164 via shaft member 168.

Shaft member 166 and shaft member 168 extend the length of the plurality of parallel tubular members fixedly coupled together and couple to a reciprocating cam connecting member and cam member, respectively, (not shown).

In operation, as shaft member 166 rotates, cam connecting member 167 reciprocates accordingly. As cam connecting member 167 rotates, cam member 163 reciprocates within the confines of angled channel structure 165 thereby moving mechanical reciprocating mechanism 164 back and forth into a receded state and an extended state, respectively. In said receded state. reciprocating mechanism 164 recedes into angled channel structure 165 and, in said extended state, a portion of reciprocating mechanism 164 protrudes from angled channel structure 165. As said portion of mechanical reciprocating mechanism 164 protrudes from angled channel structure 165, a force of pressure is applied to the build-up of comminutable material above said material inlet port thereby forcing the comminutable material through the width of said material inlet port and fissure 88 and into said first stage comminution chamber. Force feed system housing 170 comprises force feed system door member 171, handle 172 and force feed system stanchion 173. Force feed system door member 171 has coupled thereto handle 172 for allowing an operator to open force feed system door member 171 and access the interior of force feed system housing 170 for maintenance and repair, as necessary. A bottom surface of reciprocating system housing 170 has coupled thereto reciprocating system stanchion 173 which replaced bracing member 108*a*. Reciprocating system stanchion 173 couples to a respective one of the front parallel stacking stanchions 202 of said first stage comminution chamber for supporting reciprocating system housing 170.

Figure 13:
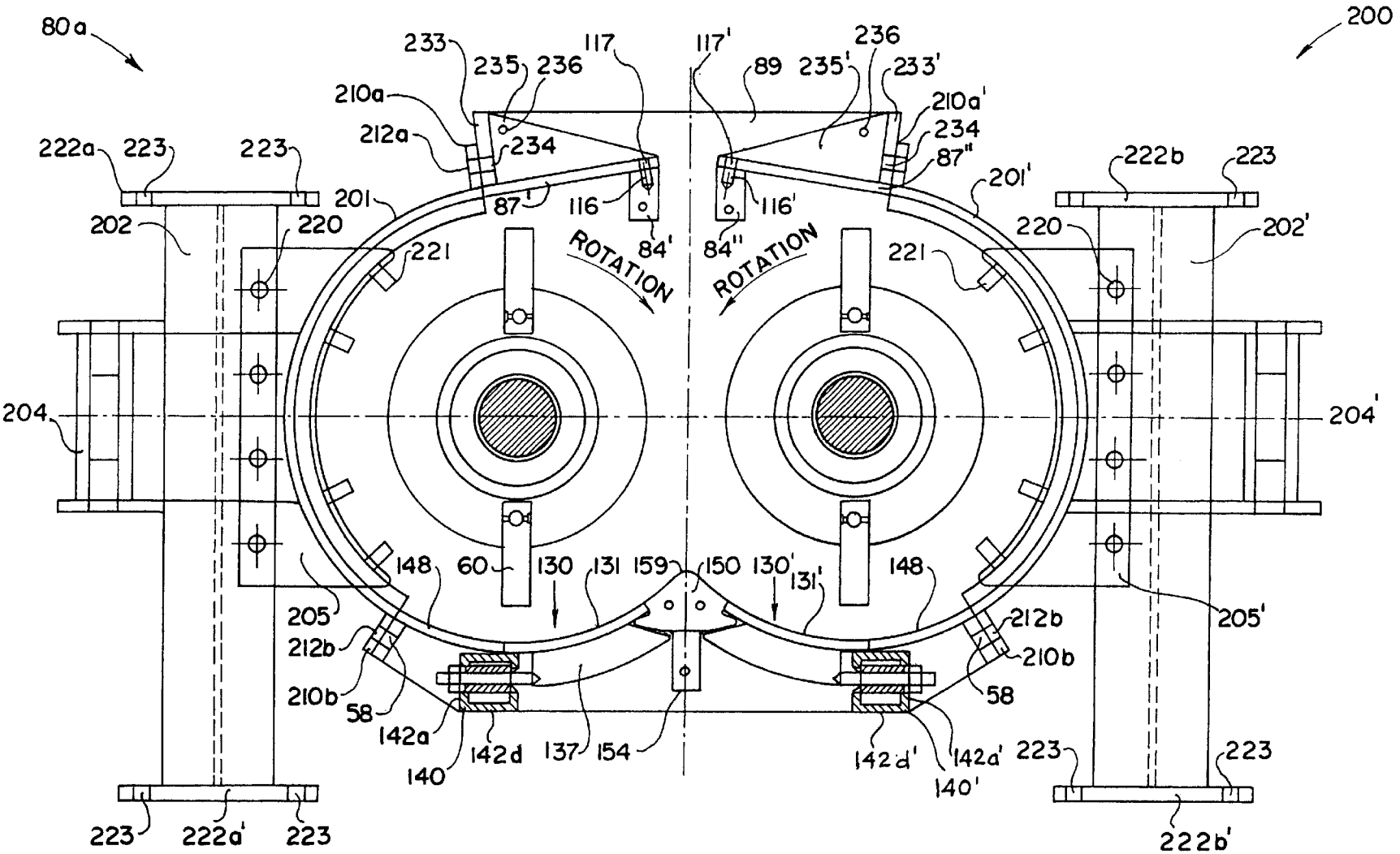
FIG. 13 illustrates an end view of the modular tiering housing structure and door support structures of FIG. 2.

Referring to FIG. 13, an end view of the modular tiering housing structure and the door support structures of the tierable, modular comminution chamber are shown. The fourth symmetrical pair of wall segments of the plurality of symmetrical pairs of wall segments of modular housing wall structure 81 comprises door structures 201 and 201' wherein door structures 201 and 201' complete the contour of barrels 85*a* and 85*a*', respectively, between first and second near-flat roof members 87' and 87" and injection inlet connecting structures 148 and 148', respectively. Tierable, modular comminution chamber 80*a*further comprises modular tiering housing structure 200. Modular tiering housing structure 200 comprises front and back parallel stacking stanchions 202 and 202' and rotating door connecting members 204 and 204' and chamber-to-stanchion support members 205 and 205'. As shown in FIG. 1, said modular tiering housing structure of the other end of tierable, modular comminution chamber 80*a* is identical except rotating door connecting members 204 and 204' are omitted. As shown, door structures 201 and 201' are symmetrical about barrels 85*a* and 85*a*', respectively, and are shaped to the contour thereof. Since door structures 201 and 201' are identical, only one such door structure will be described in detail.

Figure 14:
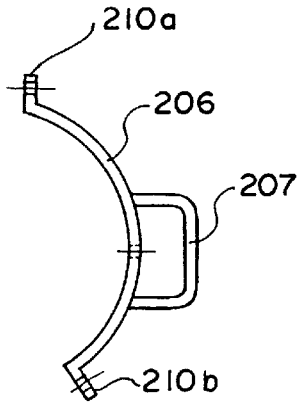
FIG. 14 illustrates an end view of the door structure of the present invention.

Referring to FIG. 1, door structure 201 comprises door surface 206 which is contoured to the formation of barrel 85*a* and extends the length of tierable, modular comminution chamber 80*a*, door handle 207, first door support member 208 and second door support member 209. Door handle 207 is coupled to door surface 206, as shown in FIG. 14, an end view of the door structure of the present invention. First door support member 208 couples to door surface 206 and has perpendicular coupled thereto second door support member 209. Second door support member 209 couples perpendicularly to rotating door connecting member 204. When an operator pulls door handle 207, door surface 206 rotatably pivots outward about rotating door connecting member 204 thereby providing access into the interior of barrel 85*a* for inspecting the interior comminution components therein, such as shaft 120, the plurality of sleeves 50, rotary lifters 73, first rectangular breaker bar members 84' and the pair of blades 60. Henceforth, maintenance of such interior comminution components is simplified wherein such interior comminution components may be easily replaced or repaired in the event of a malfunction or deterioration thereof.

In the exemplary embodiment, door surface 206 has coupled substantially in the center thereof first door support member 208 which has perpendicular coupled thereto second door support member 209. Nevertheless, second door support member 209 may be substituted with two angled second door support members coupled to first door support member 208 and stanchion 202 via two rotating door connecting members thereby forming a triangular support. Moreover, the length of the curvature conforming to the contour of barrels 85*a* and 85*a*' may be varied. For example, the length of the curvature of injection inlet connecting structures 148 and 148' may be increased thereby decreasing the length of the curvature of door structures 201 and 201', respectively.

Figure 22:
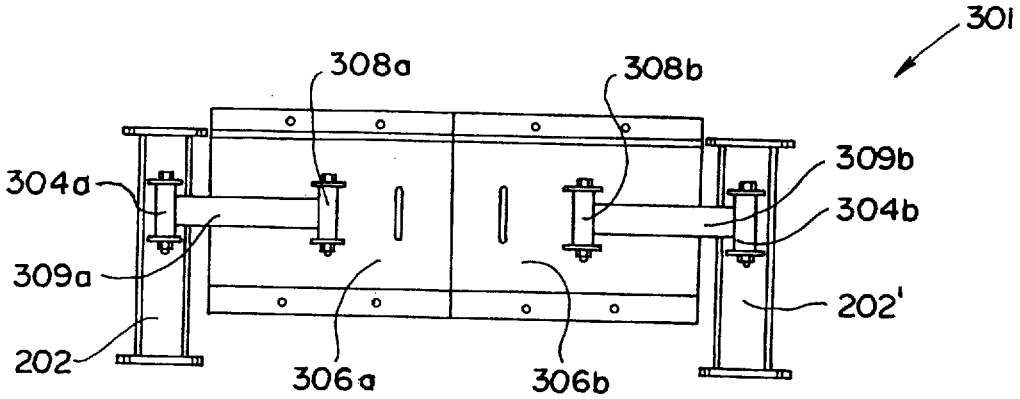
FIG. 22 illustrates an alternative embodiment of the door structure for use in the present invention.

Referring to FIG. 22, an alternative embodiment of the door structure is shown. Door structure 301 is split in the center thereby forming two door surfaces 306*a* and 306*b*. In order to open door surfaces 306*a* and 306*b*, first door support members 308*a* and 308*b* have perpendicular coupled thereto second door support members 309*a* and 309*b*, respectively. Second door support member 309*a* and 309*b* fixedly couple to stanchions 202 and 202', respectively, via rotating door connecting members 304*a* and 304*b*.

As illustrated in FIGS. 13 and 14, the top and bottom edges of the contoured surface of door structure 201 couple to door support surfaces 210*a* and 210*b*, respectively. Door support surface 210*b* abuts against support surface 148*b* of injection inlet connecting structure 148 and secured thereto via a plurality of apertures 212*b* aligned with the plurality of apertures 58 each of which receives therein a securing means (not shown). Door support surface 210*a* abuts against support surface 233 of near-flat roof member 87' which has formed therein a plurality of apertures 234 which aligns with a plurality of apertures 212a formed in door support surface 210*a*.

Modular tiering housing structure 200 further comprises two triangular bracket plates 235 and 235' which are fixedly coupled to near-flat roof members 87' and 87", respectively, at each distal end thereof. Triangular bracket plates 235 and 235' comprise apertures 236 for coupling to end side wall structures 89. The opposite end of near flat roof members 87' and 87" have fixedly coupled thereto identical triangular bracket plates for coupling to end side wall structure 89'. The vertical side walls 101 and 101' of material intake duct 100 or 100' abut against the interior surfaces of triangular bracket plates 235 and 235', as shown in FIG. 12. Support surfaces 233 and 233', of each of first and second near-flat roof members 87' and 87", respectively, each has formed therein a plurality of apertures 234 which align with a plurality of apertures 212*a* formed in door support surface 210*a* of door structure 201 thereby securing door structure 201 thereto. Prior to opening door structure 201 via door handle 207, each of the securing means, such as a bolt, (not shown) received in the plurality of apertures 212*a* and 212*b* must be removed.

In lieu of the bolting arrangement, a cam locking system to secure the door for ease of entry to perform maintenance or repair may be substituted.

Figure 9G:
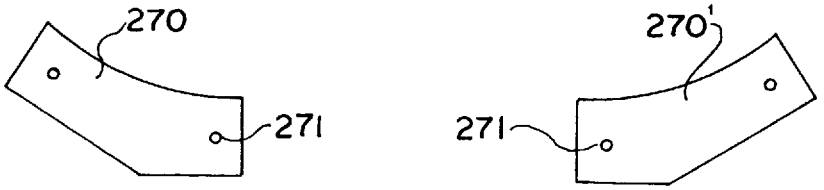
FIG. 9*g* illustrates a view of injection conduit end bracket plates of the present invention.

Referring to FIG. 9*g*, a view of the injection conduit end bracket plates is illustrated. Injection conduit end bracket plates 270 and 270' comprise apertures 271 for coupling end side wall structure 89 and 89' to each distal end of injection inlet conduits 140 and 140' and injection inlet connecting structures 148 and 148'. Each distal end of injection inlet conduits 140 and 140' and injection inlet connecting structures 148 and 148', respectively, have fixedly coupled thereto injection conduit end bracket plates 270 and 270', respectively.

Figure 23:
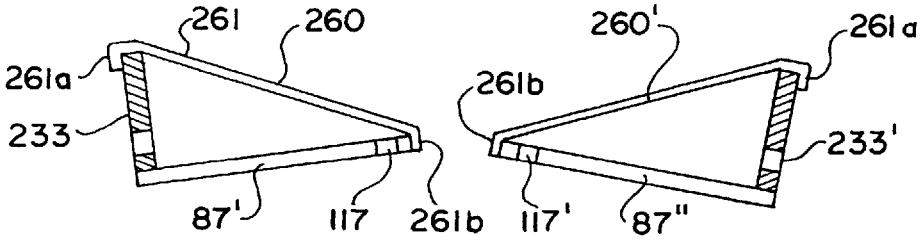
FIG. 23 illustrates the transfer conduit chute members of the present invention.

As shown in FIG. 23, transfer conduit chute members 260 and 260' comprise plate member 261 and first and second bracing surfaces 261*a* and 261*b*. Transfer conduit chute members 260 and 260' are securely coupled to support surfaces 233 and 233', respectively, via first bracing surface 261*a* and to the distal end of near-flat roof members 87' and 87" near apertures 117 and 117', respectively, via second bracing surface 261*b*. Henceforth, material exiting each stage is directed to said material inlet port of the succeeding stage via transfer conduit chute members 260 and 260', respectively.

Alternatively, the height of support surfaces 233 and 233' may be increased. Henceforth, plate member 261 of transfer conduit chute members 260 and 260' will become longer such that transfer conduit chute members become steeper.

One side of chamber-to-stanchion support members 205 and 205' have formed therein a plurality of apertures 220 for receiving therein a plurality of securing means (not shown) such as a bolt for securing chamber-to-stanchion support members 205 and 205' to stacking stanchions 202 and 202', respectively. The other side of chamber-to-stanchion support members 205 and 205' conform to the contour of barrels 85*a* and 85*a'*, respectively. Said other side of chamber-to-stanchion support members 205 and 205' comprise a plurality of securing trusses 221 which are coupled to abut against the outer surface of end wall structure 89. For illustrative purposes, end wall structure 89 is illustrated as a superimposed outline.

The end view of front and back parallel stacking stanchions 202 and 202' comprise a plurality of apertures (not shown) each of which aligns with a respective aperture of the plurality of apertures 220 for receiving therein a securing means (not shown). Front parallel stacking stanchions 202, cylindrically shaped vertical members, each has first and second support surfaces 222*a*, 222*a'*, perpendicularly coupled to each distal end thereof. Back parallel stacking stanchions 202', cylindrically shaped vertical members, each has first and second support surfaces 222*b*, 222*b'*, perpendicularly coupled to each distal end thereof. First and second support surfaces 222*a*, 222*a'* and 222*b* and 222*b'*, each has formed therein corner apertures 223 for securing said stacking stanchions of each tierable, modular comminution chamber to the stacking stanchions of the tierable, modular comminution chambers immediately above and below.

Figure 15:
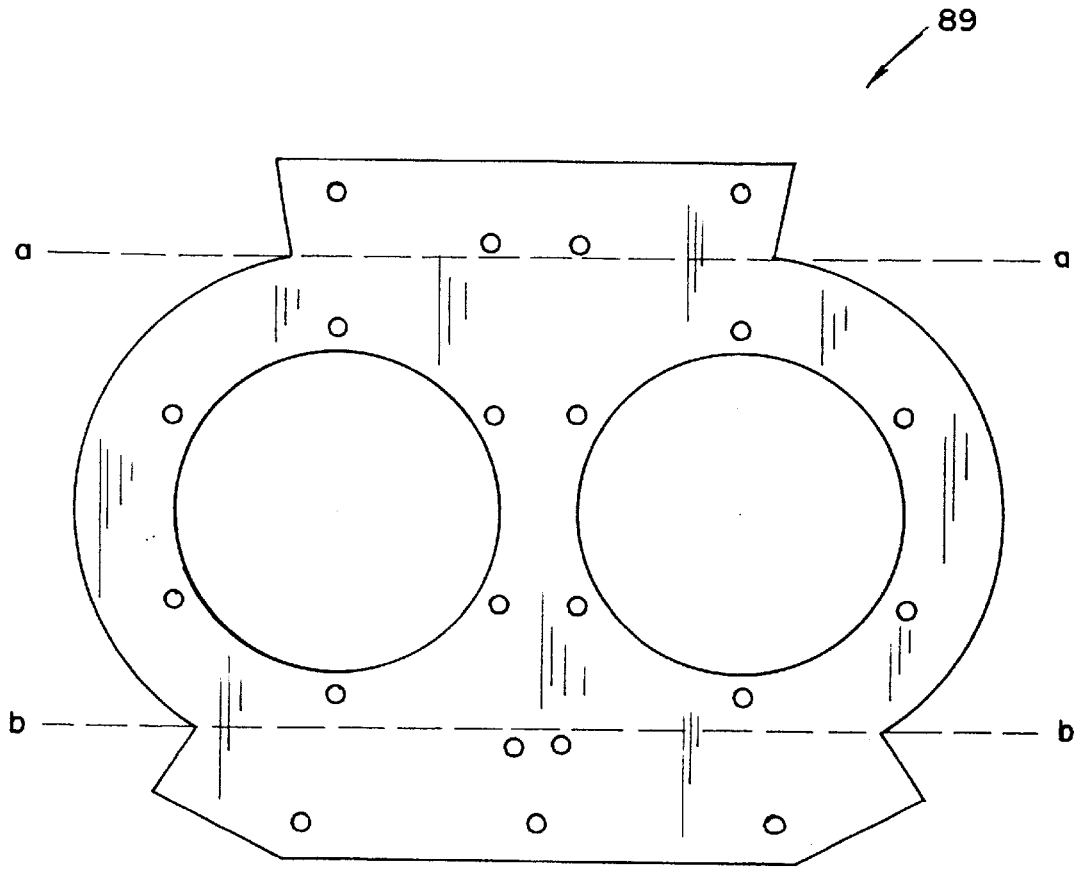
FIG. 15 illustrates a front view of the end side wall structure of the present invention.

Side wall structure 89 is shown abutting against the distal end of comminution chamber 82. As shown in FIG. 15, a front view of the end side wall structure of the present invention, end side wall structure 89 comprises a top surface area defined above line a—a, a middle surface area and a bottom surface area defined below line b—b. The middle surface area is shaped to the contour of the distal end of barrels 85*a* and 85*a'*. The top surface area extends above near-flat roof 87 and the bottom surface area extends downward to bottom surfaces of 142*d* and 142*d'* (FIG. 13) of injection inlet conduits 140 and 140'. Henceforth, the bottom surface area of end side wall structure 89 of a preceding comminution chamber coupled to the top surface area of a succeeding comminution chamber, the two parallel flushing apparatuses and transfer conduit chute members 260 and 260' (FIG. 23) define the transfer conduit for the comminuted material of the preceding stage comminution chamber to said material inlet port of the succeeding comminution chamber. End wall structure 89 comprises a plurality of apertures formed in the top surface area thereof for securing end wall structure 89 to first and second split rectangular breaker bar members 84' and 84" and triangular bracket plates 235 and 235'. The plurality of apertures formed in the bottom surface thereof couple to bottom material center guide member 150 and to each distal end of injection inlet conduits 140 and 140' via injection conduit end bracket plates 270 and 270', respectively. The middle surface area of end wall structure 89 comprises two symmetrical circles each of which has an axis which corresponds to points 11 and 11' (FIG. 3). The plurality of apertures formed in the circles of the middle surface area couple to bearing housings 123 and 123' for supporting rotary shafts 83*a* and 83*a'* journaled therethrough.

The height of said top surface area defined above line a—a and said bottom surface area defined below line b—b will vary according to the length of transfer conduit chute members 260 and 260'.

Referring to FIG. 1 and 2, power rotation system 40 comprises two motor means 41*a* and 41*b* for providing rotary power rotating rotary shafts 83*a*, 83*a'*, 83*b*, 83*b'*, 83*c* and 83*c'* and first, second and third dual sets of a plurality of belts 44, 45 and 46. Motor means 41*a* and motor means 41*b* differ only in that each counter-rotate with respect to the other. Since each of the two motor means 41*a* and 41*b* are identical except for their direction of rotation only one such motor means will be described in detail. Motor means 41*a* comprises a conventional rotary motor (not shown) housed in motor housing 42*a*. Said rotary motor (not shown) after being energized by control system 20, operates in a soft start ramp up mode for a reduction in the electrical power drain and power consumption at the installation site, such as an offshore platform or an onshore site. As each individual rotary motor of motor means 41*a* or 41*b* is energized, each individual rotary motor of motor means 41*a* and 41*b* ramps up incrementally from start to the full operational kilowatt power during their respective ramp up time windows. Coupled to motor means 41*a* is one distal end of motor cylindrical shaft member 43*a*. Motor cylindrical shaft member 43*a* protrudes from motor housing 42*a* and is parallel to rotary shaft 83*c*. The other distal end of motor cylindrical shaft member 43*a* has tightly coupled thereto the first set of the plurality of belts 44 via a rotary disc (not shown). The first set of the plurality of belts 44 couple to one distal end of rotary shaft 83*c* via a rotary disc (not shown) whereby as motor shaft cylindrical member 43*a* rotates, rotary shaft 83*c* rotates accordingly. Coupled to the other distal end of rotary shaft 83*c* and one distal end of rotary shaft 83*b* is the second set of the plurality of belts 45 via rotary discs 47*c* and 47*b*, respectively, which provides a concatenation of rotary power to rotary shaft 83*b* from rotary shaft 83*c*. The plurality of belts 45 are slidably coupled to idler arm 49 which applies a force of pressure for tightening the plurality of belts 45 during their rotation. Coupled to the other distal end of rotary shaft 83*b* and one distal end of rotary shaft 83a is the third set of the plurality of belts 46 via respective rotary discs (not shown) thereby providing a concatenation of rotary power to rotary shaft 83*a* from rotary shaft 83*b*. The plurality of belts 46 are slidably coupled to an idler arm (not shown) which applies a force of pressure for tightening the plurality of belts 46 during their rotation.

In the exemplary embodiment, concatenation of rotary power via motor means 41*a* to rotary shafts 83*a*, 83*b*, and

83*c* of the three tierable, modular comminution chambers is illustrated. Nonetheless, the rotary shafts of any number of tierable, modular comminution chambers may be linked together using the concatenation of rotary power, described above thereby providing a modular concatenation of rotary power adaptable for the desired number of tierable, modular comminution chambers.

In lieu of concatenation of rotary power, each individual shaft may be provided with its own motor means.

In the exemplary embodiment, said rotary motors of motor means 41*a* and 41*b* each produces 100 horse power and rotates at 1800 RPMS. However, a hydraulic engine or combustion engines coupled to suitable gear-boxes and belt systems may be substituted. The length of the plurality of belts of each set and the size of the rotary discs of the present invention allow each individual dual-shaft modular comminution chamber to operate at any desired tip speed. Said rotary motors are controlled by a braking system (not shown) wherein during an emergency shut down control process, said rotary motors will be controlled to shut down via said braking system. In the preferred embodiment, the first, second and third sets of belts 44, 45 and 46 are notched belts.

In the preferred embodiment, motor means 41*a* and 41*b* each produces 100 horsepower and rotates at 1800 RPMS in order to rotate the first shaft member 120, a five-inch diameter schedule 120 pipe having a length of approximately 37½ inches. In close proximity to each distal end of first shaft member 120, balancing weights 290 and 290' (FIG. 5), respectively, are fixedly coupled thereto such that balancing weight 290 is spaced 180° from balancing weight 290' for balancing rotary shaft 83*a* during its rotation. Nevertheless, any number of balancing weights spaced as needed to balance rotary shaft 83*a* may be provided. Likewise, all other rotary shafts are balanced. Second shaft members 121 and 121' are approximately 7⅛ inches and third shaft members 122 and 122' are approximately 9⅛ inches. Six sleeves 50 are spaced 6 inches apart and each has a thickness of ¾ of an inch and has a diameter of 9¼ inches. Each tierable, modular comminution chamber 80*a*, 80*b* and 80*c* have a barrel radius of approximately 8 inches and a length of approximately 40 inches. The blades of the pair of parallel blades 60 are each approximately 1 inch thick, 2 inches wide and 4¼ to 4½ inches long.

Referring to FIG. 16, injection distribution system 190 comprises a conventional pump/motor means 191, injection inlet port 192, first injection conduit means 193, first and second outlet port means 194*a* and 194*b*, second injection conduit means 195 and second injection outlet port means 196. The input side of pump/motor means 191 couples to injection inlet port 192 for receiving therefrom the injection stream from an injection stream source (not shown). The output side of pump/motor means 191 couples to first injection conduit means 193 for passing therethrough said fluid. First injection conduit means 193 couples to chamber injection inlet connectors (only 90*a* shown in FIG. 2) of the plurality of tierable, modular comminution chambers 80*a* and 80*b* via first outlet port means and second outlet port means 194*a* and 194*b*, respectively. Second injection conduit means 195 couples to second injection outlet port means 196 for passing therethrough fluid. Second injection conduit means 195 couples to chute injection inlet port 183 (FIG. 10*a* and 10*b*) of material transport system 180 for flowing therein fluid for flushing the comminuted material of the final stage of comminution through material outlet port 184 (FIG. 10*a* and 10*b*) of material transport system 180.

Injection distribution system 190 is modularly structured to provide the injection stream to any number of tierable, modular comminution chambers wherein additional tee couplings 199 are added along first injection conduit means 193. Typically, after the second stage comminution chamber, the injection stream of the fluid type is optional. Henceforth, injection distribution system 190 of the exemplary embodiment is not equipped with an outlet port means to comminution chamber 80*c*. Moreover, depending on the type of material to be comminuted, injection of the injection stream to any stage of tierable, modular comminution chambers 80*a*, 80*b* and 80*c* is only as needed.

In the exemplary embodiment, only water is injected into material intake duct 100, said first stage comminution chamber and said second stage comminution chamber. Nevertheless, it may be desirable to inject water into the material intake duct 100, said first stage comminution chamber and material transport system 180 and air into said second stage comminution chamber wherein the latter requires another injection distribution system.

It can be readily seen that the tierable, modular comminution chamber of modularly tiered clear-trajectory impact comminuter 10 is readily adaptable for most any comminutable material in any environment.

Referring to FIG. 1, control system 20 comprises housing structure 21 for housing therein electrical box panel (not shown) and operator control panel 22 for facilitating an operator to turn on and off power rotation system 40 and injection distribution system 190 and in the alternative embodiment, force feed system 160 (FIG. 12). In the exemplary embodiment, for illustrative purposes only, housing structure 21 is substantially rectangular having the surface of one of its short sides fixedly coupled to transport skid structure 30 and the surface area of the other short side having fixedly coupled thereto operator control panel 22. Preferably, housing structure 21 is made of steel or any suitable metal or metal alloy.

Operator control panel 22 of control system 20 comprises a plurality of operator controls (not shown), such as an on switch, an off switch and an emergency shut down control switch and light indicators. When the on switch is actuated, one of the rotary motors of motor means 41*a* or 41*b* is energized and, after a suitable delay, the other rotary motor of motor means 41*a* or 41*b* is energized. The emergency shut down control switch operates to immediately shut down all systems in the event of an emergency. The emergency shut down control process applies DC current to the AC motor control of power rotation system 40.

Transport skid structure 30 is designed and dimensioned to be transported via a flat bed truck to an installation site, such as an offshore platform or an onshore site. Lift support members (only 31*a* and 31*b* shown) are provided at each of the four corners on the top surface of transport skid structure 30. Each of the lift support members (only 31*a* and 31*b* shown) have formed therein apertures 32 for coupling to a lifting device (not shown) for removing the transport skid structure 30 from the flat bed truck to a water transport vehicle for further transport to the offshore platform. Transport skid structure 30 facilitates the movement of the transport skid structure 30 to any installation site thereby rendering modularly tiered clear-trajectory impact comminuter apparatus 10 mobile. Moreover, the tierable, modular comminution chambers may be assembled at the installation site. In the exemplary embodiment, transport skid structure 30 is made of carbon steel; however, any suitable strong and durable metal or metal alloy may be substituted.

INDUSTRIAL APPLICABILITY

In addition to the industrial application otherwise shown and described herein, the modularly tiered clear-trajectory impact comminuter apparatus 10 of the present invention is industrially applicable for the comminution of rock, drilling material, fibrous material or other comminutable material of various sizes. The modularly tiered clear-trajectory impact comminuter apparatus 10 modularly vertically couples in series any number of tierable, modular comminution chambers thereby optimizing the material throughput of comminuted material for any environment. Moreover, the modular construction of the tierable, modular comminution chambers simplifies the manufacturing and the assemblage of my modularly tiered clear-trajectory impact comminuter apparatus 10.

It is noted that the embodiment of my modularly tiered clear-trajectory impact comminuter apparatus I have described herein in detail for exemplary purposes is of course subject to many different variations in structure, design, application and methodology. Because many varying and different embodiments may be made within the scope of my inventive concept(s) herein taught, and because many modifications may be made in the embodiment herein detailed in accordance with the descriptive requirements of the law, it is to be understood that the details herein are to be interpreted as illustrative of my invention and not in a limiting sense.

What I claim is:

1. A comminution chamber for comminuting material comprising:

a housing wall structure forming a chamber for operatively housing therein a rotary blade and having a near-flat roof with a material inlet port formed therein; and, a breaker bar having a fissure aligned with said material inlet port for feeding therethrough said material to said chamber wherein a clear-trajectory zone is established in relation to said rotary blade and said breaker bar.

2. The comminution chamber of claim 1, wherein said zone is devoid of other stationary impediments.

3. The comminution chamber of claim 1, wherein said chamber comprises a slightly overlapping double cylindrical shaped barrel belly.

4. The comminution chamber of claim 1, wherein said near-flat roof is shaped to allow a needed clearance for a material's trajectory toward said breaker bar.

5. The comminution chamber of claim 1, wherein said housing wall structure is modular.

6. The comminution chamber of claim 5, wherein said modular housing wall structure comprises a plurality of symmetrical pairs of wall structure segments, a bottom center material guide member and end side wall structures.

7. The comminution chamber of claim 1, wherein said housing wall structure is tierable.

8. The comminution chamber of claim 1, wherein said housing wall structure is series couplable.

9. A dual-shaft modular comminution chamber for comminuting material comprising a modular housing wall structure which forms a slightly overlapping double cylindrical barrel shaped chamber for operatively housing therein a rotary blade and which has a near-flat roof with a material inlet port.

10. The comminution chamber of claim 9, further comprising a flushing apparatus for injecting in a transfer conduit an injection stream for enhancing material mobility.

11. The comminution chamber of claim 9, wherein said modular housing wall structure comprises:

first and second near-flat roof members contoured to form said near-flat roof;

first and second door structures contoured to form a portion of said slightly overlapping double cylindrical barrel shaped chamber; and, a means for exiting said material.

12. The comminution chamber of claim 11, wherein said modular housing wall structure further comprises a quasi-triangular shaped member.

13. The comminution chamber of claim 11, wherein said material exiting means comprises a screen.

14. The comminution chamber of claim 11, further comprising first and second split rectangular breaker bar members coupled to said first and second near-flat roof members, respectively.

15. The comminution chamber of claim 14, further comprising first and second near-flat roof chute members coupled above said first and second near-flat roof members.

16. A tiered comminution apparatus for comminuting material, said tiered comminution apparatus comprising:

a plurality of comminution chambers for operatively housing in each said comminution chamber a rotary blade wherein said plurality of comminution chambers includes at least a first stage comminution chamber and a final stage comminution chamber;

wherein each of said comminution chambers comprises a near-flat roof with a material inlet port and a breaker bar having a fissure aligned with said material inlet port which material inlet port, except said material inlet port in said first stage comminution chamber, couples to an output of each preceding stage comminution chamber via a transfer conduit to form a series coupling of said comminution chambers.

17. The apparatus of claim 16, wherein the coupling comprises vertical series coupling.

18. The apparatus of claim 16, wherein said output of each comminution chamber comprises a filter means for filtering comminuted material wherein the filtering means of each succeeding comminution chamber filters comminuted material dimensioned smaller than the comminuted material of the preceding stage comminution chamber.

19. The apparatus of claim 16, wherein said first stage comminution chamber has coupled to a top surface of said near-flat roof a material intake duct.

20. The apparatus of claim 19, wherein said material intake duct comprises:

two long wall surfaces;

two short wall surfaces coupled to said two long wall surface wherein an inlet conduit is formed; and two chute members extending along the length of a bottom portion of each said two long wall surfaces wherein the distance between bottom edges of said two chute members corresponds to the width of said material inlet port.

21. The apparatus of claim 20, wherein said material intake duct further comprises a force feed system having a mechanical reciprocating mechanism, said force feed system operates in a receded state and in a extended state wherein in said extended state, said mechanical reciprocating mechanism applies a force of pressure to the material above said material inlet port.

22. The apparatus of claim 16, further comprises a power rotation system for providing concatenation of rotary power.

23. The apparatus of claim 16, wherein the output of each said comminution chamber of said plurality of comminution chambers is coupled to a flushing apparatus for enhancing material mobility between said comminution chambers.

24. The apparatus of claim 23, wherein said output of each said comminution chamber comprises two parallel means for filtering, each said filtering means extends substantially the length of each said comminution chamber for passing therethrough comminuted material; and wherein said filtering means has a top surface area, defined interior the outer perimeter and is slightly concaved to conform to a surface area of barrel bellies of said comminution chamber.

25. The apparatus of claim 24, wherein the top surface area of said filtering means comprises a plurality of apertures having a size to pass therethrough the comminuted material of a desired dimension.

26. The apparatus of claim 16, wherein said output of said comminution chamber comprises a plurality of spaced filtering screen areas, each of which is separated by a distance wherein each of the filtering screen areas have formed therein a plurality of filtering apertures having a size to pass therethrough the comminuted material of a desired dimension.

27. The apparatus of claim 16, wherein said comminution chamber comprises:

a housing wall structure forming a chamber wherein a clear-trajectory zone is established in relation to said rotary blade and said breaker bar.

28. The apparatus of claim 27, wherein said zone is devoid of other stationary impediments.

29. The apparatus of claim 27, wherein said chamber is a slightly overlapping double cylindrical shaped barrel belly.

30. The apparatus of claim 27, wherein said near-flat roof is shaped to allow a needed clearance for a material's trajectory toward said breaker bar.

31. The apparatus of claim 27, wherein said housing wall structure is modular.

32. The apparatus of claim 27, wherein said modular housing wall structure comprises a plurality of symmetrical pairs of wall structure segments, a bottom material center guide member and end side wall structures.

33. The apparatus of claim 16, wherein said comminution chamber is a dual shaft comminution chamber comprising a modular housing wall structure which forms a slightly overlapping double cylindrical barrel shaped chamber.

34. The apparatus of claim 33, further comprising a flushing apparatus for injecting in said transfer conduit an injection stream for enhancing material mobility.

35. The apparatus of claim 33, wherein said modular housing wall structure comprises:

first and second near-flat roof members contoured to form said near-flat roof;

first and second door structures contoured to form a portion of said slightly overlapping double cylindrical barrel shaped chamber; and, a means for exiting said material.

36. The apparatus of claim 35, wherein said modular housing wall structure further comprises a quasi-triangular shaped member.

37. The apparatus of claim 35, wherein said material exiting means comprises a screen.

38. The apparatus of claim 35, further comprising first and second split rectangular breaker bar members coupled to said first and second near-flat roof members, respectively.

39. The apparatus of claim 38, further comprising first and second near-flat roof chute members coupled above said first and second near-flat roof members.

40. A tiered comminution apparatus for comminuting material, said tiered comminution apparatus comprising:

a plurality of modular dual-shaft comminution chambers for operatively housing in each of said modular dual-shaft comminution chambers a rotary blade wherein said plurality of dual-shaft comminution chambers includes at least a first stage comminution chamber and a final stage comminution chamber;

wherein each of said modular dual-shaft comminution chambers comprises a modular housing wall structure which is slightly overlapping double cylindrical shaped wherein said modular housing wall structure comprises:

first and second roof members contoured to form a roof with a material inlet port, first and second door structures contoured to form a portion of said slightly overlapping double cylindrical barrel shaped chamber modularly couplable to said first and second roof members, a first and second means for exiting said material modularly couplable to said first and second door structures, respectively, a quasi-triangular shaped member modularly coupled between said first and second exiting means, and a breaker bar having a fissure aligned with said material inlet port which material inlet port, except said material inlet port in said first stage comminution chamber, couples to an output of each preceding stage comminution chamber via a transfer conduit to form a series coupling of said dual-shaft comminution chambers.

41. A tiered comminution apparatus for comminuting material comprising:

a plurality of comminution chambers wherein each of said comminution chambers has means for operatively housing in each of said comminution chamber a rotary blade, wherein each of said comminution chambers comprises a near-flat roof with a material inlet port and a breaker bar having a fissure aligned with said material inlet port and wherein each of said comminution chambers are coupled in series.

* * * * *

UNITED STATES PATENT AND TRADEMARK OFFICE

CERTIFICATE OF CORRECTION

PATENT NO. : 5,829,692

DATED : November 3, 1998

INVENTOR(S) : Jerry Wayne Walters

It is certified that error appears in the above-identified patent and that said Letters Patent is hereby corrected as shown below:

On the title page, item [57]

In the abstract: In line 1, the word "commuter" should read --comminuter--

In column 8, line 9, the word "was" should be deleted. In column 9, line 48, "clear trajectory" should read --clear-trajectory--. In column 11, line 56, "configurations" should read --configuration-- . In column 12, line 25, "83a'" should read --83a--. In column 14, line 4, "89'" should read --89',--; line 30, "bar" should read --bars--. In column 16, line 4, "structure" should read --structures--. In column 19, line 27, the comma immediately after "As" should be deleted; line 40, "102'" should read --102',--. In column 21, line 7, "state." should read --state,--; line 39, "80afurther" should read --80a further--. In column 23, line 2, "structure" should read --structures--; line 48, "222*a'* and 222*b*" should read --222*a'*, 222*b*--. In column 25, line 26, the number "120" should not be highlighted because this number is not a reference numeral.

Signed and Sealed this

Twentieth Day of July, 1999

*Attest:*

*Attesting Officer*

Q. TODD DICKINSON

*Acting Commissioner of Patents and Trademarks*